US007879520B2

(12) United States Patent
Sato et al.

(10) Patent No.: US 7,879,520 B2
(45) Date of Patent: Feb. 1, 2011

(54) TONER FOR DEVELOPING ELECTROSTATIC IMAGE AND IMAGE FORMATION PROCESS USING IT

(75) Inventors: Kaori Sato, Neyagawa (JP); Masashi Yasumatsu, Neyagawa (JP)

(73) Assignee: Orient Chemical Industries, Ltd., Osaka (JP)

( * ) Notice: Subject to any disclaimer, the term of this patent is extended or adjusted under 35 U.S.C. 154(b) by 910 days.

(21) Appl. No.: 11/806,922

(22) Filed: Jun. 5, 2007

(65) Prior Publication Data

US 2007/0292779 A1 Dec. 20, 2007

(30) Foreign Application Priority Data

Jun. 16, 2006 (JP) ..... 2006-167683

(51) Int. Cl.
*G03G 9/087* (2006.01)

(52) U.S. Cl. ..... 430/108.23; 430/111.4; 430/111.41; 430/123.56

(58) Field of Classification Search ..... 430/108.23, 430/123.56
See application file for complete search history.

(56) References Cited

U.S. PATENT DOCUMENTS

| | | | | |
|---|---|---|---|---|
| 4,563,409 | A * | 1/1986 | Suzuki et al. | 430/108.23 |
| 4,623,606 | A | 11/1986 | Ciccarelli | 430/110 |
| 4,624,907 | A * | 11/1986 | Niimura et al. | 430/108.23 |
| 5,483,327 | A * | 1/1996 | Taya et al. | 399/223 |
| 5,856,055 | A * | 1/1999 | Ugai et al. | 430/108.23 |
| 6,197,467 | B1 | 3/2001 | Yamanaka et al. | 430/110 |
| 7,094,513 | B2 * | 8/2006 | Yasumatsu et al. | 430/108.23 |
| 2003/0187234 | A1 | 10/2003 | Yasumatsu et al. | 534/715 |
| 2005/0208409 | A1 | 9/2005 | Yasumatsu et al. | 430/108.23 |
| 2006/0154165 | A1 | 7/2006 | Yasumatsu et al. | 430/108.23 |
| 2009/0280426 | A1 * | 11/2009 | Kunii et al. | 430/108.23 |

FOREIGN PATENT DOCUMENTS

| | | |
|---|---|---|
| EP | 1 096 324 | 5/2001 |
| EP | 1 571 497 | 9/2005 |
| JP | 61-101558 | 5/1986 |
| JP | 61-155463 | 7/1986 |
| JP | 01-260461 | 10/1989 |
| JP | 02-032365 | 2/1990 |

* cited by examiner

*Primary Examiner*—Christopher RoDee
*Assistant Examiner*—Roland Martin, Jr.
(74) *Attorney, Agent, or Firm*—Steptoe & Johnson LLP

(57) ABSTRACT

A toner for developing an electrostatic image comprises a binding resin for a toner and a charge control agent including an azo-type iron complex salt represented by the following chemical formula (1)

(1)

(in the chemical formula (1), $R^1$ and $R^3$ are the same or different to each other and are an alkyl group having a straight chain or a branch chain of 3 to 8 carbons; $R^{2a}$, $R^{2b}$, $R^{4a}$ and $R^{4b}$ are the same or different to each other and are selected from the group consisting of a hydrogen atom, an alkyl group, an alkoxyl group, a halogen atom, a nitro group and a carboxyl group; $A^+$ indicates $m(H^+)+n(K^+)+p(Na^+)$, which m, n and p satisfy numerical equations of $m+n+p=1$, $0.7 \leqq m \leqq 1$, $0 \leqq n \leqq 0.3$ and $0 \leqq p \leqq 0.3$), wherein an average particle size thereof is 1 to 4 microns, and a specific volume resistivity thereof is ranging from $0.2\times10^{15}$ to $7\times10^{15}$ Ω·cm.

14 Claims, 3 Drawing Sheets

TONER FOR DEVELOPING ELECTROSTATIC IMAGE AND IMAGE FORMATION PROCESS USING IT

BACKGROUND OF THE INVENTION

This invention relates to a toner for developing an electrostatic image comprising a negative electrostatic charge control agent including azo-type iron complex salt, which is used for a toner or a powder paint.

An image formation process of an electrophotography system is applied to a copy machine, a printer or a facsimile. The electrophotography system is performed by developing an electrostatic latent image on a photosensitive frame with a photosensitive layer having inorganic or organic photoconductive materials by toner having frictional electrification, transferring the imaged toner and then fixing onto a paper.

A charge control agent which adjusts the electrification of the toner appropriately is beforehand added to the toner so as to quicken a rise speed of the electrification, electrify sufficiently, control a proper quantity of the electrification stably, improve electrification property, control an electrostatic latent image stably, rise up a speed for developing an electrostatic latent image, and form the vivid images with high quality.

For instance, as such charge control agent, negative electrified metallic complex salts are mentioned in Japanese Patent Provisional Publication Nos. 61-101558, 61-155463 and 62-177561.

In recent years, a copy machine and a printer cause high efficiency with improving resolution and so on. The electrophotography system is used with not only a high speed development but also a low speed development for widespread purposes. Therefore, it is required that the charge control agent causes faster rise speed of the electrification of the toner and more excellent electrification property. It also requires the agent to be able to form the vivid images with high resolution and be manufactured simply with the sufficient yield. The toner using the charge control agent is also required. Furthermore, it is required that the charge control agent is able to be used in a powder paint for an electrostatic powder printing method which attracts and bakes the electrostatic powder paint onto a surface of a frame work having charge.

DISCLOSURE OF THE INVENTION

The present invention has been developed to solve the foregoing problems. It is an object of the present invention to provide the toner for developing the electrostatic image comprising the charge control agent that causes the fast rise speed of the electrification, excellent electrification property, the toner to form the vivid images with high resolution and to maintain the electrification stably with the passage of time, and excellent environmental stability.

The inventors of the present invention found out that the toner having excellent electrification property could be obtained by appropriately adjusting an average particle size and a specific volume resistivity of the specific azo-type iron complex salt in the charge control agent and completed the present invention.

A toner for developing an electrostatic image of the present invention developed for accomplishing the foregoing object comprises a binding resin for a toner, and a charge control agent including an azo-type iron complex salt represented by the following chemical formula (1)

(1)

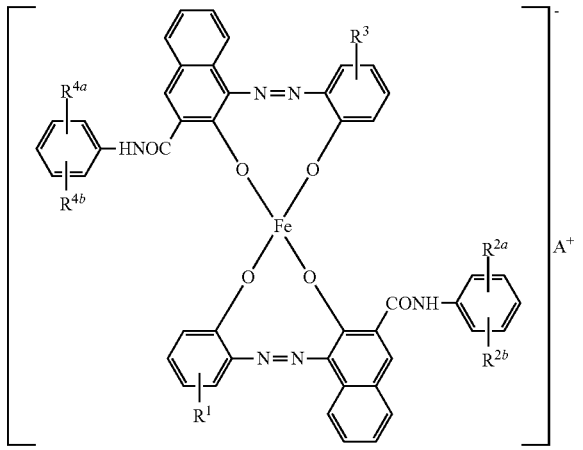

(in the chemical formula (1), $R^1$ and $R^3$ are the same or different to each other and are an alkyl group having a straight chain or a branch chain of 3 to 8 carbons; $R^{2a}$, $R^{2b}$, $R^{4a}$ and $R^{4b}$ are the same or different to each other and are selected from the group consisting of a hydrogen atom, an alkyl group, an alkoxyl group, a halogen atom, a nitro group and a carboxyl group; $A^+$ indicates $m(H^+)+n(K^+)+p(Na^+)$, which m, n and p satisfy numerical equations of $m+n+p=1$, $0.7 \leqq m \leqq 1$, $0 \leqq n \leqq 0.3$ and $0 \leqq p \leqq 0.3$), wherein an average particle size thereof is 1 to 4 microns, and a specific volume resistivity thereof is ranging from $0.2\times10^{15}$ to $7\times10^{15}$ Ω·cm. In addition, m, n and p in the formula of $m(H^+)+n(K^+)+p(Na^+)$ indicates an existence ratio (i.e. a molar ratio) of a counter ion (i.e. cation) in the azo-type iron complex salt represented by the chemical formula (1).

It is preferable that a rate of weight-decrease of the azo-type iron complex salt in the toner for developing the electrostatic image by a differential thermal-thermogravimetric analysis (TG/DTA) is 90% or more.

It is preferable that the toner for developing the electrostatic image further comprises a wax.

It is preferable that a liberation rate of the azo-type iron complex salt liberated from the toner, which is determined by a central metal: Fe derived from a free azo-type iron complex salt thereby, ranges from 0.01 to 3%.

It is preferable that a rate of decrease of a quantity of electrification of the toner under high temperature of 35° C. and high humidity of 90% relative humidity to a quantity of electrification of the toner under 25° C. and 50% relative humidity is ranging from 0.1 to 10%.

It is preferable that the toner for developing the electrostatic image comprises 0.1 to 10 parts by weight of the charge control agent and 100 parts by weight of the binding resin for a toner.

An image formation process of the present invention comprises steps of: a step for forming a toner layer on a frame holding a developer that is arranged with an interval towards a frame holding an electrostatic latent image by absorbing the developer including the toner for developing the electrostatic image, and a step for developing an electrostatic latent image by absorbing the toner in the toner layer onto the frame holding the electrostatic latent image.

The charge control agent used for the toner for developing the electrostatic image of the present invention has an excellent negative charge-investing property, an excellent stability and an excellent dispersibility to the resin for the toner. The toner for developing the electrostatic image of the present invention, which includes the charge control agent, has a quick rise speed of the electrification, excellent electrification stability for long period of time, excellent preservation stability and excellent durability. The toner for developing the electrostatic image contains little impurity, so it has high safety and excellent environmental stability.

The image formation process using the toner realizes a fixing ability under an extensive range of temperature, and non-offset property. According to the process, stable copy images are formed.

MODE FOR CARRYING OUT THE INVENTION

Figure 1:
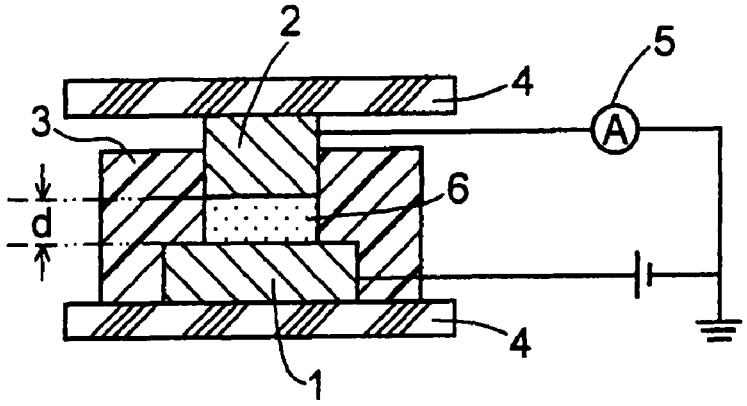
FIG. 1 is an outline figure showing an apparatus for measuring the specific volume resistivity of the charge control agent comprising the azo-type iron complex salt to which the present invention is applied.

Hereunder, embodiments of the present invention are explained in detail. However, the invention is not limited to these embodiments.

The inventors of the present invention studied and found that a particle size and a resistance property of the charge control agent affect a development property and a transcription property when the image is formed by the toner comprising the charge control agent.

The charge control agent used for the present invention comprises the azo-type iron complex salt represented by the chemical formula (1). The counter ion $A^+$ of the azo-type iron complex salt in the charge control agent, which is indicated by the formula of $m(H^+)+n(K^+)+p(Na^+)$, satisfies numerical equations of $0.7 \leqq m \leqq 1$, $0 \leqq n \leqq 0.3$ and $0 \leqq p \leqq 0.3$. It is preferable that the specific volume resistivity of the azo-type iron complex salt is ranging from $0.2\times10^{15}$ to $7\times10^{15}$ Ω·cm. The charge control agent shows sufficient electrification-controlling property, when a content of $H^+$ in the charge control agent is higher or the specific volume resistivity is a regular higher value.

The method for manufacturing the charge control agent comprising the azo-type iron complex salt comprises steps of:

a first-step of a diazotization coupling reaction for preparing the monoazo compound;

a second-step of an iron-complexing reaction of the monoazo compound by an iron-complexing agent;

a third-step for obtaining the azo-type iron complex salt represented by the formula (1) through preparing a counter ion, washing and purifying if necessary; and a fourth step for filtrating and drying the azo-type iron complex salt.

In the above steps, it is important that generated impurities, especially impurities in connection with metals other than iron(Fe) in the iron-complexing agent, are removed. For example, if the charge control agent is contaminated by impurities in connection with metal of Mn (the hydroxide of the metal is presumed), the problem that the charge control property thereof is declined, arises. Concretely, round 3000 ppm of Mn was usually detected from iron sulfate of a general industrial grade used as the iron-complexing agent.

The azo-type iron complex salt with the suitable specific volume resistivity is obtained by optimizing the dissolution process of the monoazo compound in the second-step of the iron-complexing reaction of the monoazo compound, by improving the efficiency of iron-complexing reaction, by preparing the azo-type iron complex salt under acidic condition and then precipitating, filtrating, washing and purifying thereof.

If the specific volume resistivity of the toner including the charge control agent comprising the azo-type iron complex salt is smaller than this range, the generated charge is leaked. If the specific volume resistivity thereof is larger than this range, the generated charge is stored too much and lacks the stability thereof. It is preferable that the specific volume resistivity thereof is ranging from $0.5\times10^{15}$ to $5.0\times10^{15}$ Ω·cm.

The toner including the charge control agent comprising the azo-type iron complex salt, which has such specific volume resistivity, maintains sufficient electrification, and it has an excellent rise speed of the electrification and an excellent stability for long period of time.

The specific volume resistivity is measured in accordance with Japanese Industrial Standard (JIS) K6911.

If the content of $H^+$ in the counter ion $A^+$ of the azo-type iron complex salt in the charge control agent is higher, a hydrophilic salt structure thereof is fewer, so there is little influence of humidity or other environment on the charge control agent. Consequently, the charge control agent has a sufficient saturated-electrification property and an excellent environmental stability. Furthermore, the charge control agent has a physical property that the rate of weight-decrease of the azo-type iron complex salt by the differential thermal-thermogravimetric analysis is 90% or more, for reasons of the structure thereof and a reduction treatment of impurities. When the rate of weight-decrease of the azo-type iron complex salt is 90% or more, the saturated-electrification and the environmental stability of the toner comprising the charge control agent are excellent.

It is preferable that the average particle size of the azo-type iron complex salt of the charge control agent is controlled to 1 to 4 microns, by performing the iron-complexing reaction in water or in water-organic solvent mixed solution, preferably in monohydric lower alcohol-water mixed solution, and by preparing the counter ion and controlling the particle size. When the particle size of the charge control agent is controlled appropriately, the charge control agent is dispersed into the toner sufficiently. Consequently, toner particles with stable electrification are obtained. If the average particle size of the azo-type iron complex salt is larger than this range, the azo-type iron complex salt is eliminated or liberated from the toner easily.

It is preferable that the charge control agent used for the present invention comprises the azo-type iron complex salt represented by the chemical formula (1) of which the average particle size is 1 to 4 microns and the specific volume resistivity is ranging from $0.2\times10^{15}$ to $7\times10^{15}$ Ω·cm, especially ranging from $0.5\times10^{15}$ to $5.0\times10^{15}$ Ω·cm. The toner for developing the electrostatic image comprising the charge control agent has the excellent property such as the above-mentioned capability or the physical property, so it achieves the fast rise speed of the electrification and the excellent electrification property stably, and forms the vivid images with high resolution.

When the alkyl group in the azo-type iron complex salt represented by the chemical formula (1) has a longer carbon chain, hydrophobicity thereof improves. Consequently, the charge control agent has an excellent saturated-electrification property and an excellent environmental stability. Particularly the toner for developing the electrostatic image has further excellent electrification property when $R^1$ or $R^3$ of the azo-type iron complex salt represented by the chemical formula (1) is butyl group, especially tert-butyl group.

Generally, the toner comprising the azo-type iron complex salt as the charge control agent induces comparatively high quantity of the frictional electrification. But the quantity of the electrification of such toner is reduced under high humidity condition because of increase of the quantity of adsorbed water to the azo-type iron complex salt. The speed of the electrification of such toner is lowered under low humidity condition because of a high resistance resulting from a decrease of the quantity of adsorbed water in the azo-type iron complex salt. In spite of the general toner of prior art, the toner comprising the azo-type iron complex salt represented by the formula (1) as the charge control agent brings about the excellent environmental stability to the humidity because the combination of a skeletal structure of the azo-type iron complex ion and the counter ion is appropriate.

The method for manufacturing the charge control agent comprising the azo-type iron complex salt is explained more concretely.

In the first-step of the diazotization coupling reaction, it is preferable that the monoazo compound is obtained by the conventional diazotization coupling reaction in water or in water-organic solvent mixed solution, preferably in monohydric lower alcohol-water mixed solution.

In the second-step of the iron-complexing reaction, it is preferable that the iron-complexing reaction of the monoazo compound obtained in the first-step is performed with the iron-complexing agent in water or in water-organic solvent mixed solution, preferably in monohydric lower alcohol-water mixed solution. Examples of the iron-complexing agent are ferric sulfate, ferrous sulfate, ferric chloride, ferrous chloride, and ferric nitrate.

An important point of the manufacturing method is control of the proper amount of the counter ion of the product of the azo-type iron complex salt. Therefore, it is necessary to determine the amount of the alkaline metal (for example sodium) of the reaction mixture prepared by the diazotization coupling reaction using such as sodium nitrite in the diazotization coupling process, and the residual amount of the alkaline metal (for example sodium) of the monoazo compound.

An alkali such as sodium hydroxide or potassium hydroxide is adjusted by subtraction of the residual amount of the alkaline metal in the monoazo compound. In the iron-complexing reaction of the monoazo compound, the alkali is added to the mixed solvent of butanol and water dispersing the monoazo compound, and then the iron-complexing agent is added thereto. By the iron-complexing reaction, the azo-type iron complex salt having the desired ratio of the counter ion is prepared simply.

In the iron-complexing reaction of the monoazo compound, the dispersibility of the monoazo compound in the reaction solvent is poor. Consequently, a reaction efficiency of the iron-complexing reaction is declined. In order to obtain the azo-type iron complex salt having little impurities with high yield, it is important for the present invention that the monoazo compound is dispersed sufficiently and finely while adjusting pH with the alkali. In this case, it is preferable that potassium hydroxide is used as the alkali.

It is necessary that the azo-type iron complex salt is filtered out under acidic condition while controlling the desired counter ion of the azo-type iron complex salt, and is washed sufficiently. For instance, the salt is washed with water at 60° C. from which the metal is removed. It is preferable that an electric conductivity of the obtained filtrate is 200 μS or less.

The obtained charge control agent is fluffy and has fine particle size and uniform shape, so it is crushed easily. If necessary, the charge control agent is pulverized using a pulverizing machine such as a jet mill, or is classified.

It is preferable that a specific surface area: x of the azo-type iron complex salt obtained by the above-mentioned method satisfies a formula of $5 \leqq x \leqq 15$ ($m^2/g$), preferably satisfies a formula of $5 \leqq x \leqq 10$ ($m^2/g$). When the specific surface area is within the range, the charge control property of the charge control agent is improved more. So the images with high definition are obtained using the toner comprising the charge control agent.

Hereunder, concrete examples of the azo-type iron complex salt represented by the chemical formula (1) are mentioned.

In the chemical formula (1), substituents $R^1$ and $R^3$ are an alkyl group having a straight chain or a branch chain of 3 to 8 carbons such as n-propyl group, iso-propyl group, n-butyl group, iso-butyl group, tert-butyl group, n-pentyl group, iso-pentyl group, hexyl group, heptyl group and octyl group. Substituents $R^{2a}$, $R^{2b}$, $R^{4a}$ and $R^{4b}$ are a hydrogen atom; an alkyl group such as methyl group, ethyl group, iso-propyl group, n-butyl group, tert-butyl group, pentyl group, hexyl group, heptyl group and octyl group; an alkoxyl group such as methoxyl group, ethoxyl group, propoxyl group and butoxyl group; a halogen atom such as F, Cl, Br and I; a nitro group; and a carboxyl group.

As preferable example [I], the azo-type iron complex salt represented by the chemical formula (1) is the azo-type iron complex salt represented by the following chemical formula (2).

(2)

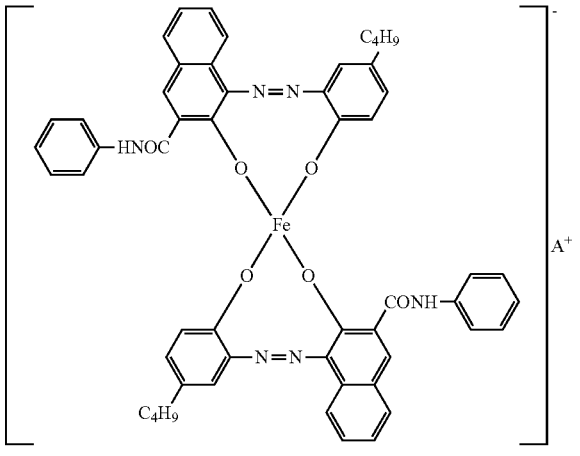

[in the chemical formula (2), $A^+$ indicates $m(H^+)+n(K^+)+p(Na^+)$, which m, n and p satisfy numerical equations of $m+n+p=1$, $0.7 \leqq m \leqq 1$, $0 \leqq n \leqq 0.3$ and $0 \leqq p \leqq 0.3$].

As much preferable example [II], the azo-type iron complex salt represented by the chemical formula (1) is the azo-type iron complex salt represented by the chemical formula (2), and in the chemical formula (2), $A^+$ indicates $m(H^+)+n(K^+)$, which m and n satisfy numerical equations of $m+n=1$, $0.7 \leqq m \leqq 1$ and $0 \leqq n \leqq 0.3$.

As further preferable example [III], the azo-type iron complex salt represented by the chemical formula (1) is the azo-type iron complex salt represented by the chemical formula (2) having 1 to 3 microns of the average particle size thereof, and in the chemical formula (2), $A^+$ indicates $m(H^+)+n(K^+)$, which m and n satisfy numerical equations of $m+n=1$, $0.9 \leqq m \leqq 0.99$ and $0.01 \leqq n \leqq 0.1$.

Other concrete examples of the azo-type iron complex salt represented by the chemical formula (1) are shown below. However, the present invention is certainly not limited to these examples.

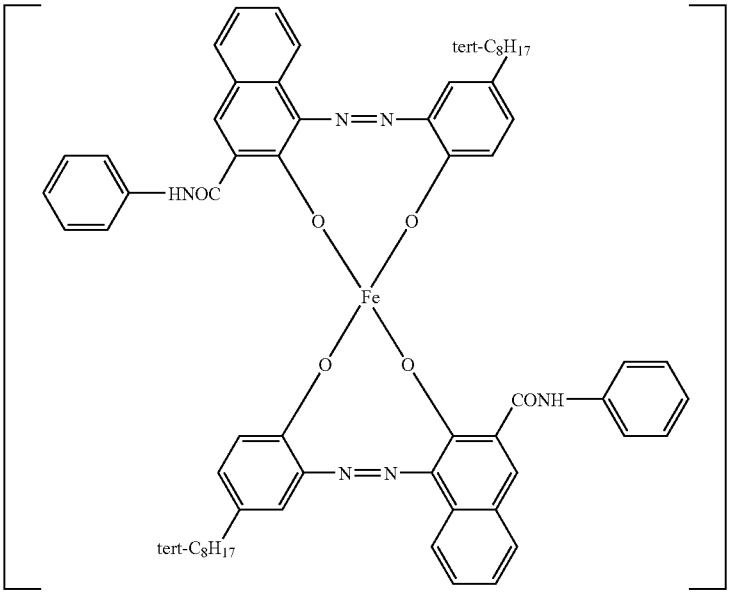

$[m_1(H^+) + n_1(K^+) + p_1(Na^+)]^-$

[in the formula, the counter ions are mixed cations of hydrogen ion, potassium ion and sodium ion, and the existence ratio thereof is indicated by numbers that satisfy numerical equations of $0.7 \leqq m_1 \leqq 1$, $0 \leqq n_1 \leqq 0.3$ and $0 \leqq p_1 \leqq 0.3$ respectively, which $m_1$, $n_1$ and $p_1$ satisfy numerical equation of $m_1+n_1+p_1=1$]

[in the formula, the counter ions are mixed cations of hydrogen ion and potassium ion, and the existence ratio thereof is indicated by numbers that satisfy numerical equations of $0.99 \leqq m_2 \leqq 1$ and $0 \leqq n_2 \leqq 0.01$ respectively, which $m_2$ and $n_2$ satisfy numerical equation of $m_2+n_2=1$]

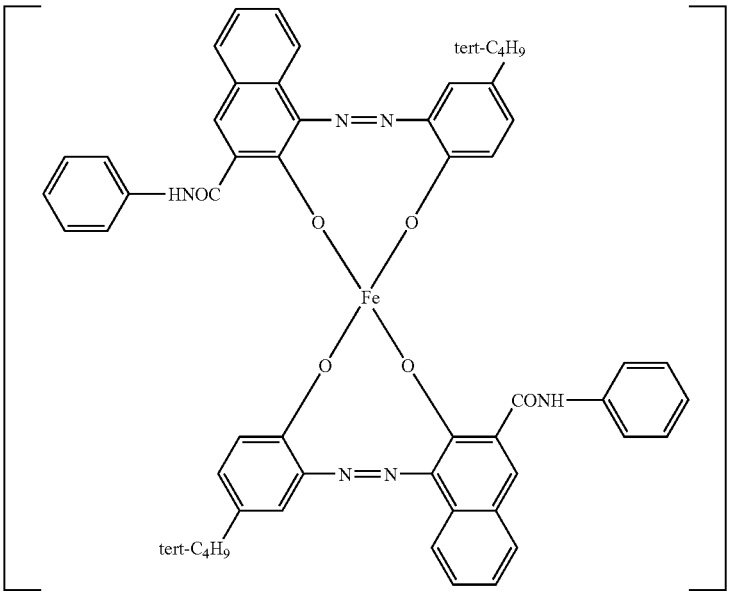

$[m_2(H^+) + n_2(K^+)]^-$

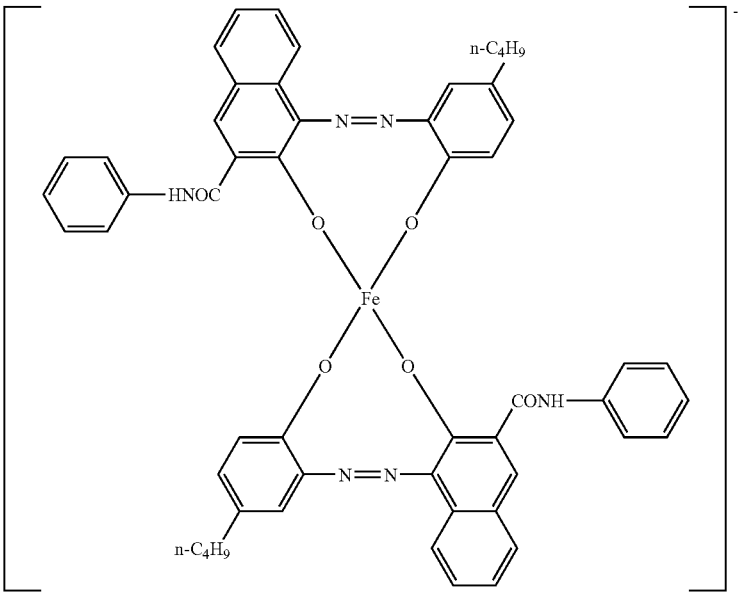

$[m_3(H^+) + n_3(K^+) + p_3(Na^+)]$

[in the formula, the counter ions are mixed cations of hydrogen ion, potassium ion and sodium ion, and the existence ratio thereof is indicated by numbers that satisfy numerical equations of $0.9<m_3<1$, $0<n_3<0.1$ and $0<p_3<0.1$ respectively, which $m_3$, $n_3$ and $p_3$ satisfy numerical equation of $m_3+n_3+p_3=1$]

[in the formula, the counter ions are mixed cations of hydrogen ion and potassium ion, and the existence ratio thereof is indicated by numbers that satisfy numerical equations of $0.9 \leqq m_4<1$ and $0<n_4 \leqq 0.1$ respectively, which $m_4$ and $n_4$ satisfy numerical equation of $m_4+n_4=1$]

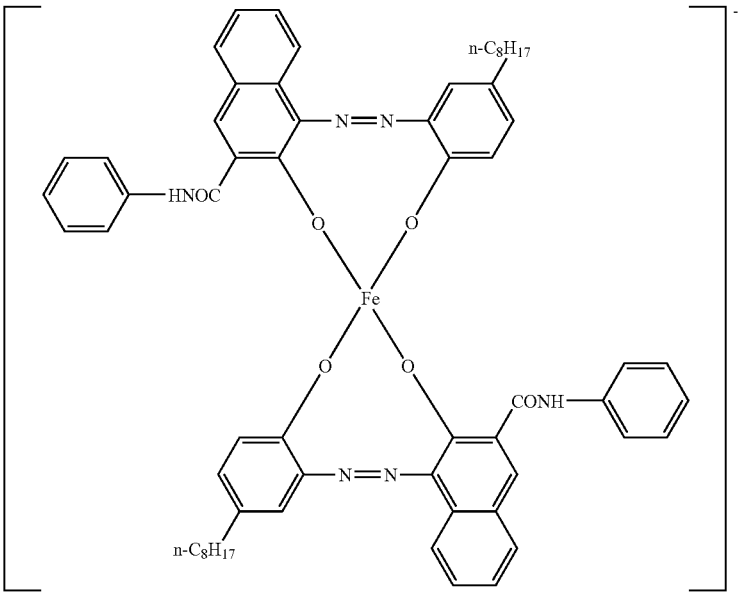

$[m_4(H^+) + n_4(K^+)]$

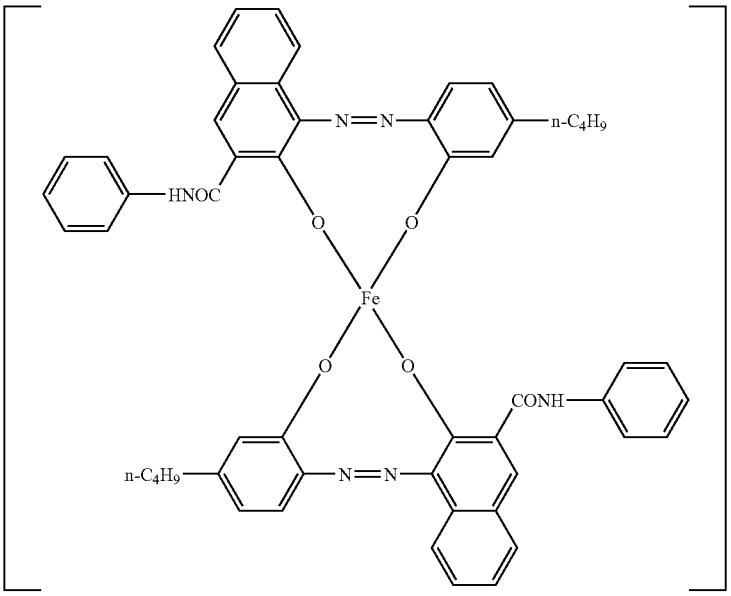

$[m_5(H^+) + n_5(K^+) + p_5(Na^+)]$

[in the formula, the counter ions are mixed cations of hydrogen ion, potassium ion and sodium ion, and the existence ratio thereof is indicated by numbers that satisfy numerical equations of $0.75<m_5<1$, $0<n_5<0.25$ and $0<p_5<0.25$ respectively, which $m_5$, $n_5$ and $p_5$ satisfy numerical equation of $m_5+n_5+p_5=1$]

[in the formula, the counter ions are mixed cations of hydrogen ion and potassium ion, and the existence ratio thereof is indicated by numbers that satisfy numerical equations of $0.9 \leqq m_6<1$ and $0<n_6 \leqq 0.1$ respectively, which $m_6$ and $n_6$ satisfy numerical equation of $m_6+n_6=1$]

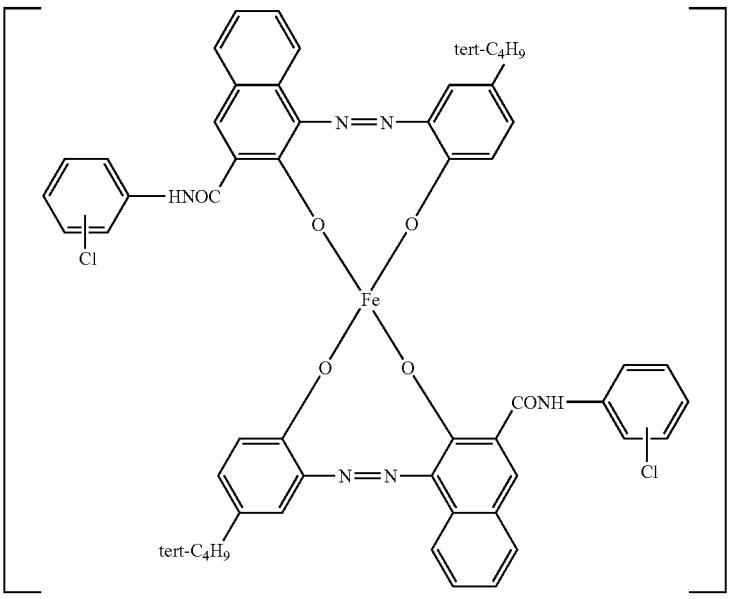

$[m_6(H^+) + n_6(K^+)]$

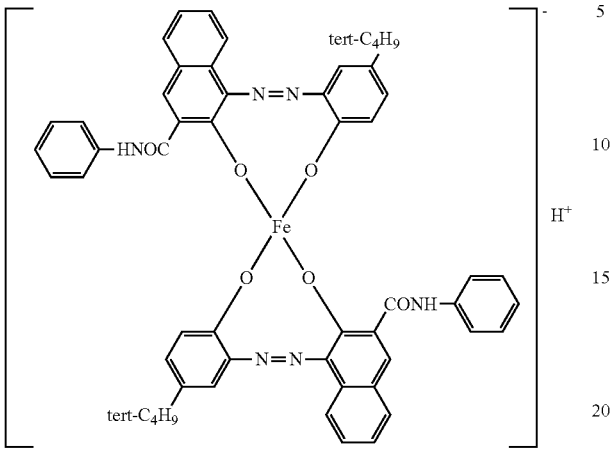
[in the formula, the counter ion is hydrogen ion.]
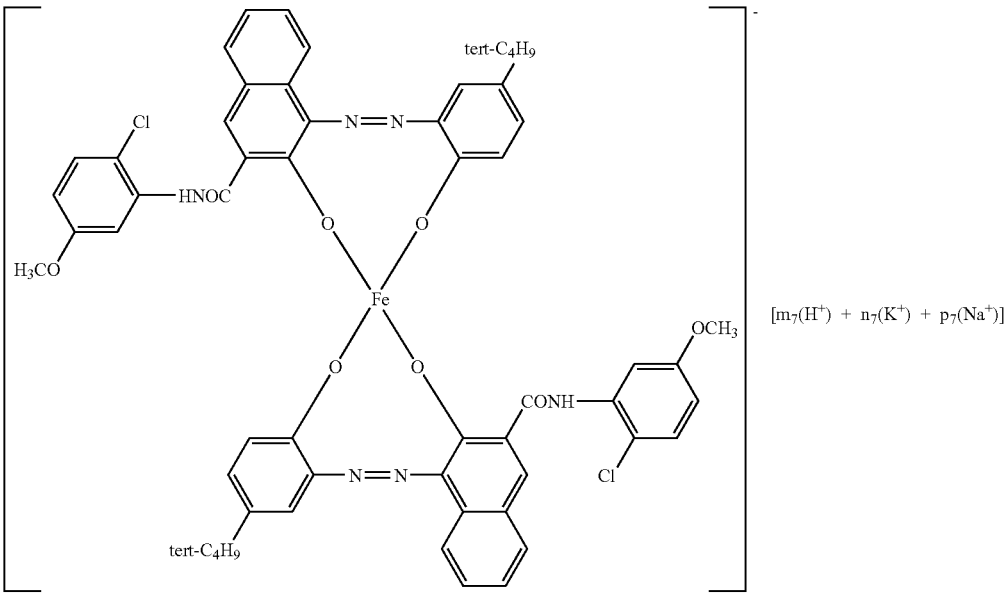
[in the formula, the counter ions are mixed cations of hydrogen ion, potassium ion and sodium ion, and the existence ratio thereof is indicated by numbers that satisfy numerical equations of $0.99 \leqq m_7 \leqq 1$, $0 \leqq n_7 \leqq 0.01$ and $0 \leqq p_7 \leqq 0.01$ respectively, which $m_7$, $n_7$ and $p_7$ satisfy numerical equation of $m_7+n_7+p_7=1$]

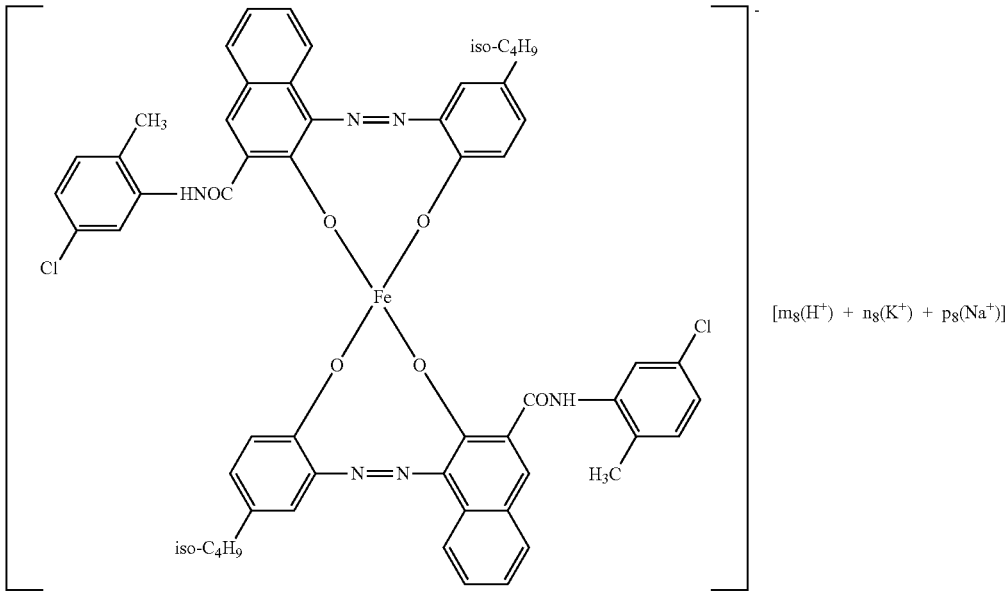

[in the formula, the counter ions are mixed cations of hydrogen ion, potassium ion and sodium ion, and the existence ratio thereof is indicated by numbers that satisfy numerical equations of $0.995 \leqq m_8 \leqq 1$, $0 \leqq n_8 \leqq 0.005$ and $0 \leqq p_8 \leqq 0.005$ respectively, which $m_8$, $n_8$ and $p_8$ satisfy numerical equation of $m_8+n_8+p_8=1$]

[in the formula, the counter ions are mixed cations of hydrogen ion, potassium ion and sodium ion, and the existence ratio thereof is indicated by numbers that satisfy numerical equations of $0.997 \leqq m_9 \leqq 1$, $0 \leqq n_9 \leqq 0.003$ and $0 \leqq p_9 \leqq 0.003$ respectively, which $m_9$, $n_9$ and $p_9$ satisfy numerical equation of $m_9+n_9+p_9=1$]

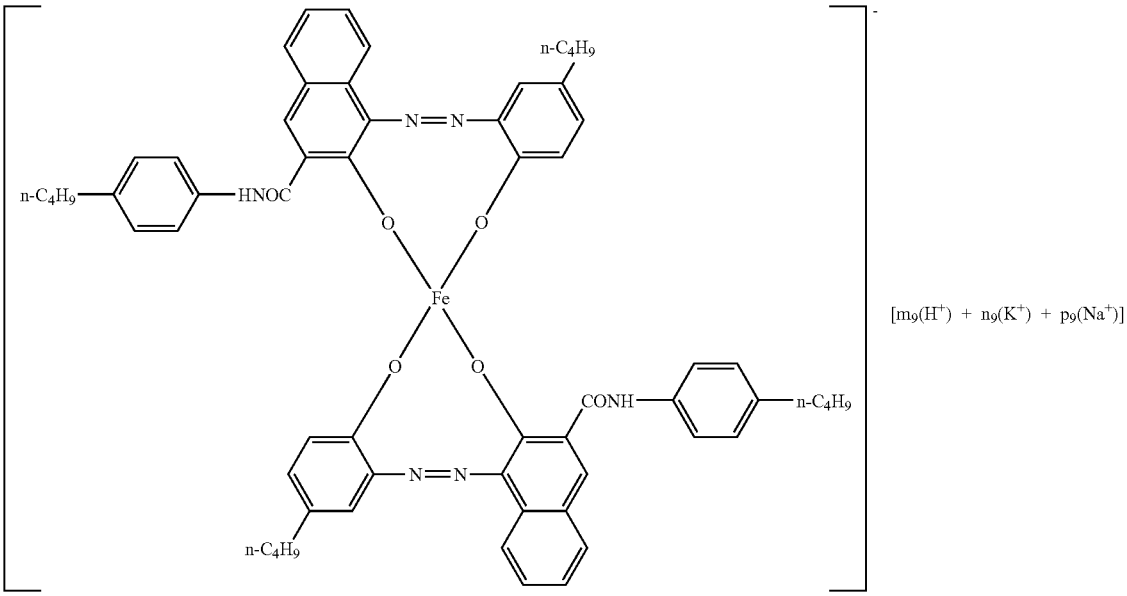

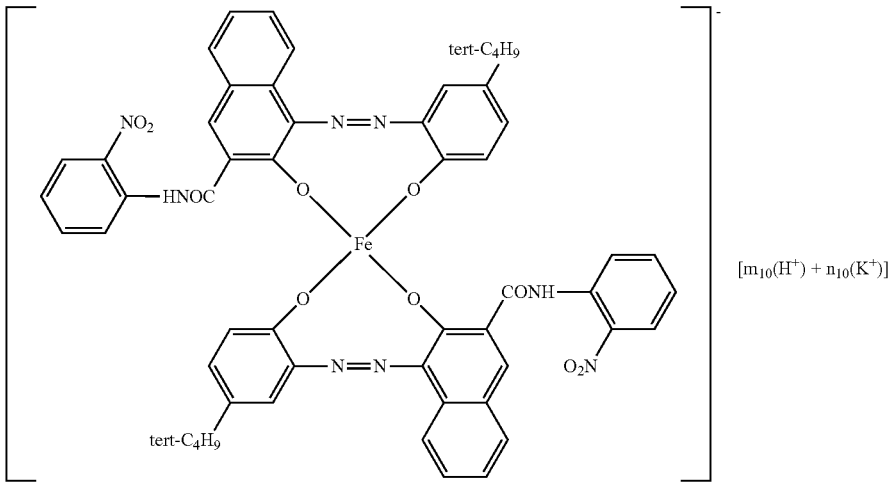

[in the formula, the counter ions are mixed cations of hydrogen ion and potassium ion, and the existence ratio thereof is indicated by numbers that satisfy numerical equations of $0.7 \leqq m_{10} < 1$ and $0 < n_{10} \leqq 0.3$ respectively, which $m_{10}$ and $n_{10}$ satisfy numerical equation of $m_{10}+n_{10}=1$]

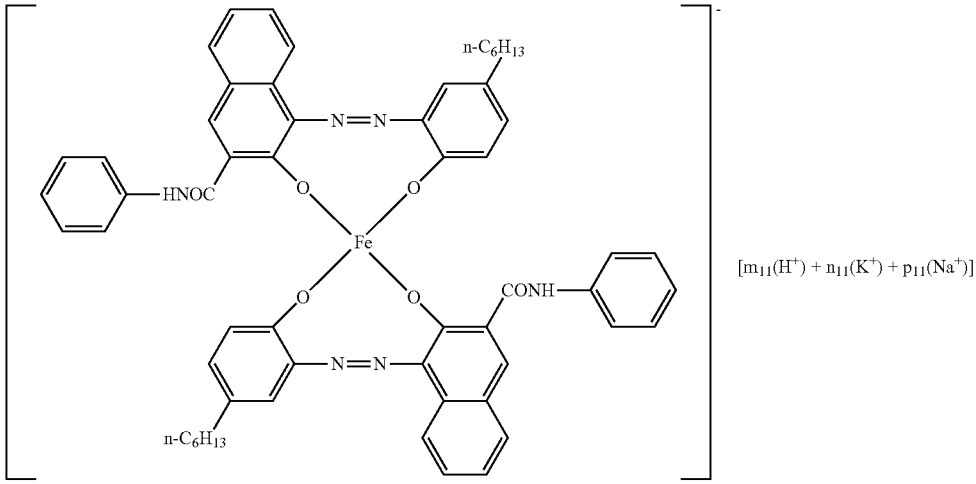

[in the formula, the counter ions are mixed cations of hydrogen ion, potassium ion and sodium ion, and the existence ratio thereof is indicated by numbers that satisfy numerical equations of $0.8 \leqq m_{11} \leqq 0.998$, $0.01 \leqq n_{11} \leqq 0.2$ and $0 \leqq p_{11} \leqq 0.01$ respectively, which $m_{11}$, $n_{11}$ and $p_{11}$ satisfy numerical equation of $m_{11}+n_{11}+p_{11}=1$]

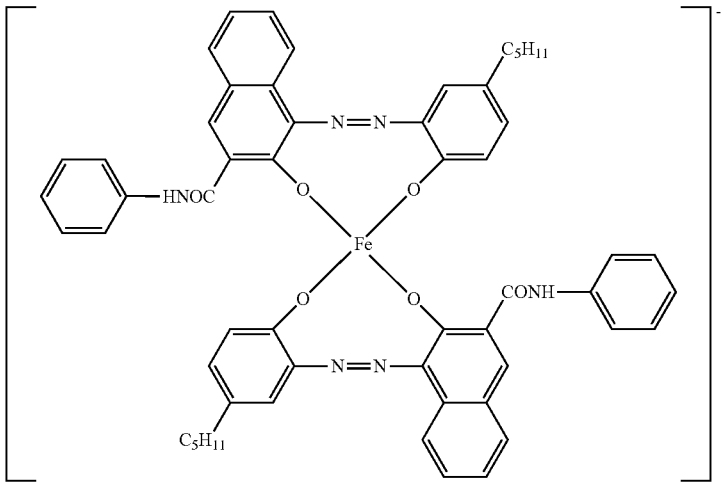

$[m_{12}(H^+) + n_{12}(K^+) + p_{12}(Na^+)]$

[in the formula, the counter ions are mixed cations of hydrogen ion, potassium ion and sodium ion, and the existence ratio thereof is indicated by numbers that satisfy numerical equations of $0.8 \leqq m_{12} \leqq 1.0$, $0 \leqq n_{12} \leqq 0.2$ and $0 \leqq p_{12} \leqq 0.2$ respectively, which $m_{12}$, $n_{12}$ and $p_{12}$ satisfy numerical equation of $m_{12}+n_{12}+p_{12}=1$]

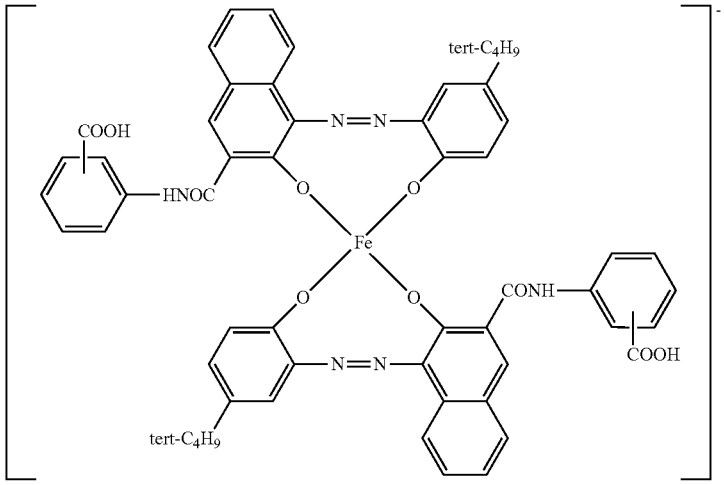

$[m_{13}(H^+) + n_{13}(K^+) + p_{13}(Na^+)]$

[in the formula, the counter ions are mixed cations of hydrogen ion, potassium ion and sodium ion, and the existence ratio thereof is indicated by numbers that satisfy numerical equations of $0.75 \leqq m_{13} \leqq 1.0$, $0 \leqq n_{13} \leqq 0.25$ and $0 \leqq p_{13} \leqq 0.25$ respectively, which $m_{13}$, $n_{13}$ and $p_{13}$ satisfy numerical equation of $m_{13}+n_{13}+p_{13}=1$]

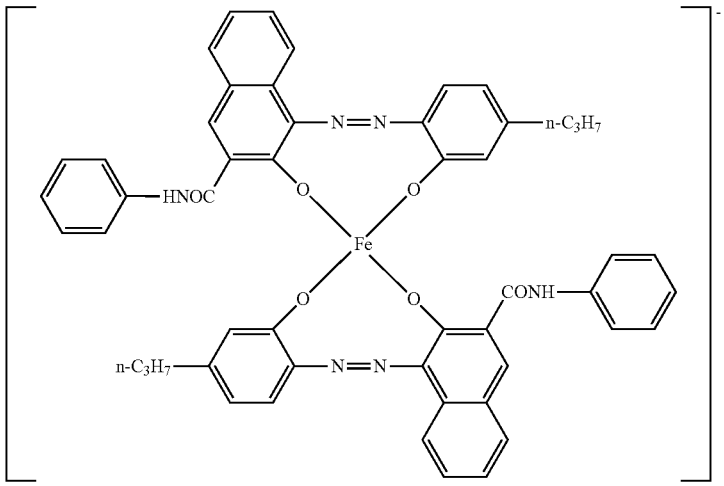

$[m_{14}(H^+) + n_{14}(K^+) + p_{14}(Na^+)]$

[in the formula, the counter ions are mixed cations of hydrogen ion, potassium ion and sodium ion, and the existence ratio thereof is indicated by numbers that satisfy numerical equations of $0.7 \leqq m_{14} \leqq 1$, $0 \leqq n_{14} \leqq 0.3$ and $0 \leqq p_{14} \leqq 0.3$ respectively, which $m_{14}$, $n_{14}$ and $p_{14}$ satisfy numerical equation of $m_{14}+n_{14}+p_{14}=1$]

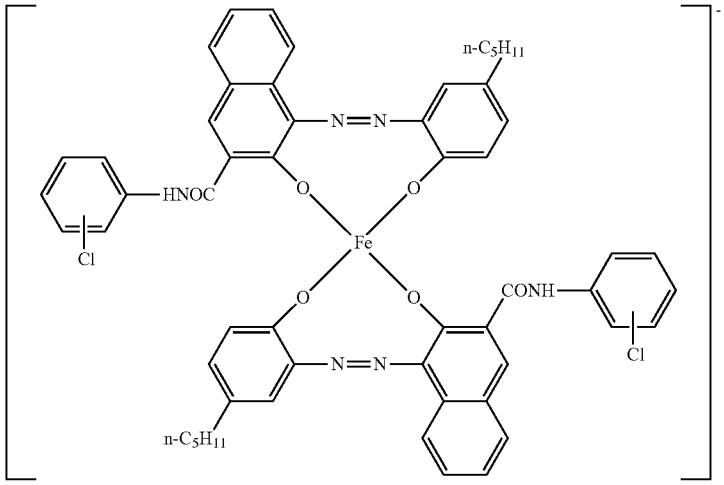

$[m_{15}(H^+) + n_{15}(K^+) + p_{15}(Na^+)]$

[in the formula, the counter ions are mixed cations of hydrogen ion, potassium ion and sodium ion, and the existence ratio thereof is indicated by numbers that satisfy numerical equations of $0.75 \leqq m_{15} \leqq 1$, $0 \leqq n_{15} \leqq 0.25$ and $0 \leqq p_{15} \leqq 0.25$ respectively, which $m_{15}$, $n_{15}$ and $p_{15}$ satisfy numerical equation of $m_{15}+n_{15}+p_{15}=1$]

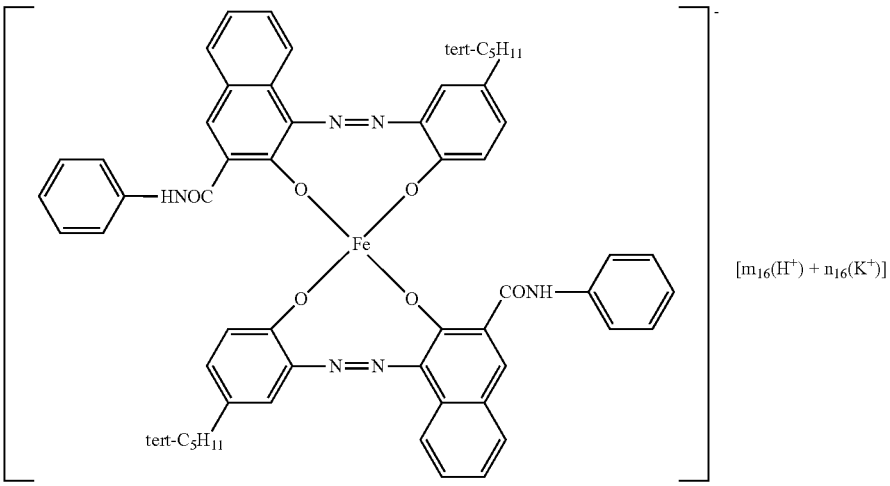

[in the formula, the counter ions are mixed cations of hydrogen ion and potassium ion, and the existence ratio thereof is indicated by numbers that satisfy numerical equations of $0.995 \leqq m_{16} \leqq 1$ and $0 \leqq n_{16} \leqq 0.005$ respectively, which $m_{16}$ and $n_{16}$ satisfy numerical equation of $m_{16}+n_{16}=1$]

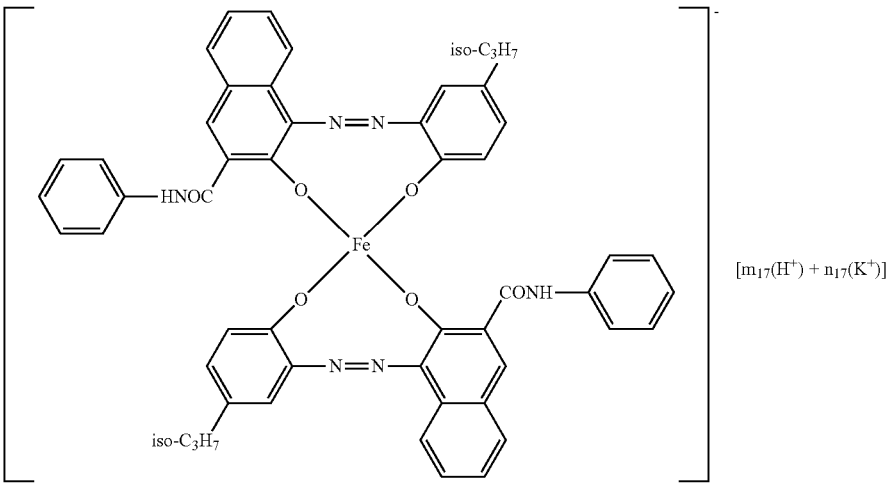

[in the formula, the counter ions are mixed cations of hydrogen ion and potassium ion, and the existence ratio thereof is indicated by numbers that satisfy numerical equations of $0.8 \leqq m_{17} \leqq 1$ and $0 \leqq n_{17} \leqq 0.2$ respectively, which $m_{17}$ and $n_{17}$ satisfy numerical equation of $m_{17}+n_{17}=1$]

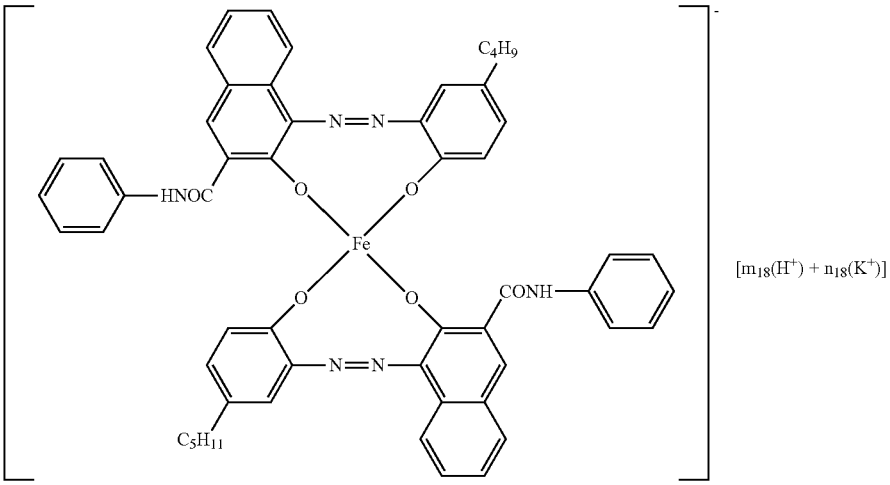

[in the formula, the counter ions are mixed cations of hydrogen ion and potassium ion, and the existence ratio thereof is indicated by numbers that satisfy numerical equations of $0.7 \leqq m_{18} \leqq 1$ and $0 \leqq n_{18} \leqq 0.3$ respectively, which $m_{18}$ and $n_{18}$ satisfy numerical equation of $m_{18}+n_{18}=1$]

The toner for developing the electrostatic image of the present invention comprises the charge control agent including the above-mentioned azo-type iron complex salt represented by the chemical formula (1). More concretely, for example the toner comprises 100 parts by weight of the resin for the toner, 0.1 to 10 parts by weight of the charge control agent, and 0.5 to 10 parts by weight of the colorant.

The toner for developing the electrostatic image prepared with the charge control agent causes fast rise speed of the electrification under the high or low speed development of the electrostatic latent image. Further the toner causes electrifying sufficient quantity of charge and keeping stable electrification.

In the toner for developing the electrostatic image prepared with the charge control agent, it is preferable that the liberation rate of the charge control agent liberated from the toner particle, namely the liberation rate of the iron of the central metal determined by the particle analyzer, is ranging from 0.01 to 3% in order to maintain the excellent property of the charge control agent. Consequently, the charge control agent always exists on a surface of the toner particles, so the electrification of the toner is homogeneous and the toner has the excellent rise speed of the electrification.

On the other hand, in a comparative toner that a charge control agent is remarkably eliminated or liberated from toner particles, the liberated or eliminated charge control agent adheres or is fixed onto the surface of the carrier, after charging the toner or printing many sheets. Consequently, the charge-investing property of the carrier is remarkably declined, and such the toner causes the fogginess and scattering of the toner.

The liberation rate of the charge control agent is obtained for example by measuring of particles of iron using particle analyzer DP-1000 that is available from HORIBA, Ltd. commercially. Thus toner analysis using the particle analyzer is explained in Japan Hardcopy '97 Treatise, p. 65-68.

The charge control agent of which the specific volume resistivity and the particle size are regulated has the excellent environmental stability. In the toner for developing the electrostatic image comprising the charge control agent, the rate of decrease of a quantity of electrification thereof is as few as 0.1 to 10% when the environmental stability thereof is evaluated under high temperature and high humidity. Therefore, change of the tone of the image caused by the toner, and generation of the fogginess or the scattering of the toner, are depressed to the minimum.

The copied images using the negative electrified toner by the friction are vivid and high quality. The toner causes the faster rise speed of the electrification thereof. So the toner develops the electrostatic latent image clearly and forms vivid images with high resolution, not only under high speed copying but also under low speed copying at rotating speed of at most 600 cm/min. The toner has the excellent copying property.

The toner for developing the electrostatic image is manufactured for example as follows. The binding resin for the toner, the colorant, the charge control agent, and if necessary an additive such as a magnetic material or a fluid improvement agent, are sufficiently mixed by a blender such as a ball mill. It is kneaded with melting by a heat-kneading machine such as a heating roll, a kneader or an extruder. After cooling and solidification thereof, it is granulated and classified to obtain the toner having the average particle size ranging from 5 to 20 microns.

The toner for developing the electrostatic image can be manufactured by a preparing method that materials are dispersed into the binding resin solution and then it is sprayed and dried. The toner for developing the electrostatic image can also be manufactured by a polymerization method that a monomer for the binding resin and predetermined materials are mixed to obtain an emulsion suspension and then the emulsion suspension is polymerized to obtain the toner. The polymerization method is mentioned in Japanese Patent Provisional Publication Nos. 1-260461 and 2-32365.

The toner for developing the electrostatic image can be used as a binary component developer. In this case, the developer is prepared with mixing the toner and a carrier powder. For example, this developer is used for developing by a binary component magnetic brush development method and so on.

As the carrier powder, all well-known carrier powder can be used and it is not particularly limited. Concrete examples of the carrier powder are powder of which particle size is ranging from 50 to 200 microns such as iron or nickel or ferrite, and glass beads. Or it may be the modified powder thereof or the modified beads thereof whose surfaces are coated with an acrylate copolymer, a styrene-acrylate copolymer, a silicone resin, a polyamide resin or a fluoroethylene resin.

The toner for developing the electrostatic image can also be used as a monocomponent developer. In this case, the developer is prepared with adding and dispersing ferromagnetic particulates such as powder of iron or nickel or ferrite on the occasion of preparing the toner. This developer is used for developing by a contact development method or a jumping development method.

The known synthetic resins and natural resins are used as the binding resin for the toner that is included in the toner for developing the electrostatic image. Examples of the binding resin are styrene homopolymer or substituted-styrene homopolymer such as polystyrene, poly-p-chlorostyrene, and polyvinyltoluene; styrene type copolymer such as styrene-p-chlorostyrene copolymer, styrene-vinyltoluene copolymer, styrene-vinylnaphthalene copolymer, styrene-acrylate copolymer, styrene-methacrylate copolymer, styrene-methyl alpha-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer. Examples of co-monomer reacted with styrene monomer of the styrene type copolymer are monocarboxylic acid derivative having a double bond and substituted derivative thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, and acrylamide; dicarboxylic acid derivative having a double bond and substituted derivative thereof such as maleic acid, butyl maleate, methyl maleate, and dimethyl maleate; vinyl chloride; vinyl ester derivative such as vinyl acetate, and vinyl benzoate; ethylene type olefin derivative such as ethylene, propylene, and butylene; vinyl ketone derivative such as vinyl methyl ketone, and vinyl hexyl ketone; vinyl ether derivative such as vinyl methyl ether, vinyl ethyl ether, and vinyl isobutyl ether. The exemplified co-monomer may be used solely or plurally with mixing.

The binding resin may be the styrene type polymer cross-linked by a cross linking agent. As the cross linking agent, compounds having two or more double bonds that are able to polymerize are used. Examples of the cross linking agent are aromatic divinyl derivative such as divinylbenzene, divinylnaphthalene; carboxylate derivative having two double bonds such as ethylene glycol diacrylate, ethylene glycol dimethacrylate, and 1,3-butanediol dimethacrylate; divinyl derivative such as divinylaniline, divinyl ether, divinyl sulfide, and divinyl sulfone; and derivatives having three or more vinyl groups. The exemplified cross linking agent may be used solely or plurally with mixing.

The binding resin may be polyvinyl chloride, phenol resin, natural resin-denatured phenol resin, natural resin-denatured maleic acid resin, acrylic resin, methacrylic resin, polyvinyl acetate, silicone resin, polyester resin, polyurethane resin, xylene resin, polyamide resin, furan resin, epoxy resin, polyvinyl butyral, terpene resin, cumarone-indene resin, petroleum resin.

The toner for developing the electrostatic image may include a known dye or pigment as the colorant. Examples of the colorant are a carbon black such as acetylene black, lamp black, thermal black, furnace black, channel black, ketjen black; a titanium black; a black iron oxide.

A mold releasing agent may be added in the toner for developing the electrostatic image. It is preferable that the mold releasing agent are paraffin having 8 or more carbons such as paraffin wax, paraffin latex, and microcrystalline wax; polyolefin such as polypropylene wax, polyethylene wax. The exemplified mold releasing agent may be used solely or plurally with mixing. It is preferable that the additive amount of the mold releasing agent ranges from 0.3 to 10 weight %. If the additive amount of the mold releasing agent is less than 0.3 weight %, it acts as the mold releasing agent insufficiently in the occasion of the fixing of the images. If the additive amount thereof is more than 10 weight %, it causes defective electrification, scattering of the toner from the frame holding the developer and declining of the quality of the images, because of increasing the exposure thereof on the surface of the toner. And it causes declining cleaning property because of increasing the adhesion between the toner particles, or interaction between the toner and the layer-formed blade or the frame holding the developer.

It is preferable that the wax has an average molecular weight ranging from 3000 to 10000 because it acts well as the mold releasing agent and improves an offset prevention property of the toner.

A magnetic toner including a magnetic material may be added in the toner for developing the electrostatic image. Examples of the magnetic material are metallic oxides including an element such as iron, cobalt, nickel, copper, magnesium, manganese, and zinc. It is preferable that the magnetic material has BET (Brunauer-Emmett-Teller) specific surface area determined by a nitrogen absorption method ranging from 1 to 20 $m^2/g$, and is magnetic powder having Moh's hardness ranging from 5 to 7. The magnetic material generally has a shape of octahedron, hexahedron, globe, needle, or scale. It is preferable that the magnetic material has the shape with little anisotropy such as the octahedron, the hexahedron or the globe. Particularly, the magnetic material having the shape of the isotropy accomplishes the sufficient dispersion to the binding resin and the wax in the toner. It is preferable that the average particle size of the magnetic material is ranging from 0.05 to 1.0 microns.

Preferably 50 to 200 parts by weight, further preferably 70 to 150 parts by weight of the magnetic material are added to 100 parts by weight of the binding resin for the toner. If the magnetic material is less than 50 parts by weight, a carrier property of the toner is insufficient, the developer layer on the frame holding the developer causes unevenness, the images tend to be uneven, and the tone of the image tends to decrease because of raising the electrification of the developer excessively. If the magnetic material is more than 200 parts by weight, the tone of the image tends to decrease because of the insufficient electrification of the developer.

Inorganic fine powder or hydrophobic inorganic fine powder may be added to the toner for developing the electrostatic image in order to improve the environmental stability, the electrification stability, the development property, the fluidity, and the preservation property. Examples of the powder are a fine silica powder, a fine titanium oxide powder, and a hydrophobic-treated material thereof. The powder may be used solely or plurally with mixing.

As the fine silica powder, dry silica prepared from silicon halide by oxidative vapor deposition that is called a dry-type method; another dry silica that is called a fumed silica; another dry silica of conjugated fine powder of silica and another metal oxide, which is prepared from silicon halide and metal halide such as aluminum chloride or titanium chloride by dry process; so-called wet silica prepared from water glass and so on are mentioned. Especially, the dry silica, that has few silanol groups on its surface or its inside and has little residual of $Na_2O$ or a preparative residual group such as $SO_3^{2-}$ and so on, is preferable.

It is preferable that the fine silica powder is carried out hydrophobic-treatment. The hydrophobic-treatment has a procedure of treating with an organic silicon compound and so on that reacts or physically absorbs to the fine silica powder. It is preferable that the hydrophobic-treatment has the procedure of treating the fine dry powder prepared from silicon halide by oxidative vapor deposition with a silane coupling agent, and the simultaneous or continuous procedure of treating with the organic silicon compound such as silicone oil.

Examples of the silane coupling agent used for the hydrophobic-treatment, are hexamethylenedisilazane, trimethylsilane, trimethylchlorosilane, trimethylethoxysilane, dimethyldichlorosilane, methyltrichlorosilane, allyidimethylchlorosilane, allylphenyldichlorosilane, benzyldimethylchlorosilane, bromomethyldimethylchlorosilane, alpha-chloroethyltrichlorosilane, beta-chloroethyltrichlorosilane, chloromethyldimethylchlorosilane, triorganosilylmercaptan, trimethylsilylmercaptan, triorganosilylacrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane that has 2 to 12 siloxane units per one molecule and has each of the terminal units having a hydroxyl group bound to a silicon atom.

An example of the organic silicon compound is a silicone oil. Preferable examples of the silicon oil are dimethylsilicone oil, methylphenylsilicone oil, alpha-methylstyrene-denatured silicone oil, chlorophenylsilicone oil, fluorine-denatured silicone oil.

An external additive agent may be added to the toner for developing the electrostatic image, if necessary. Examples of the external additive agent are fine resin powder and fine inorganic powder that acts as an electrostatic auxiliary, a conductive provider agent, a fluid provider agent, a caking inhibitor, a mold releasing agent for heat roller fixing, a lubricant, an abrasive material and a development improver.

Examples of the fluid provider agent are titanium dioxide and aluminum oxide. Especially the hydrophobic fluid provider agent is preferable.

Examples of the lubricant are polytetrafluoroethylene, zinc stearate, and polyvinylidene fluoride. Examples of the abrasive material are cerium oxide, silicon carbide, and strontium titanate.

Examples of the conductive provider agent are carbon black, zinc oxide, antimony oxide, and tin oxide.

An example of the development improver is a small amount of white fine particles or black fine particles having reversed polarity.

Hereunder, embodiments of the image formation process are explained in detail.

The image formation process comprises orderly steps of:

a step for forming the latent image on the frame holding the latent image, a step for developing that the latent image is developed on the frame holding the latent image using the developer layer, which is formed onto the frame holding the developer, to form the toner images, a step for transferring that the toner images are transferred to a transcription sheet, a step for cleaning, and a step for fixing that the toner images on the transcription sheet are fixed thermally.

In regard to the step for forming the latent image, the electrostatic latent image is formed by a known method such as an electrophotography method or an electrostatic recording method on a photosensitive frame holding the latent image, that consist of a photosensitive layer or a dielectric layer and a cylindrical frame having thereof. The photosensitive layer is made from materials such as an organic compound and amorphous silicon. The cylindrical frame having the photosensitive layer is prepared by injection molding of aluminum or aluminum alloy and processing of surface finishing.

In regard to the step for developing, the thin developer layer is formed onto the frame holding the developer as a rotating cylindrical development roll by using a layer-formed blade such as an elastic blade. After it is conveyed to a development position, bias voltage is applied between the development roll and the frame holding the latent image. The electrostatic latent image is developed by the developer, and then the toner images are formed. The development roll and the frame holding the latent image contact at the development position, or are arranged with a fixed aperture.

Examples of the frame holding the mono-component developer used as one of the frame holding the developer are a elastic sleeve made of silicone rubber; a drawing sleeve which is made form ceramics or metal such as aluminum and stainless steel (SUS); a sleeve of which the surface is treated by oxidizing, polishing, blasting or resin-coating in order to control the conveyance property and the electrification property of the toner. The toner layer is formed onto the development roll by contacting between the layer-formed blade and the surface of the sleeve. When the layer-formed blade is the elastic blade, it is preferable that its material is elastic rubber such as silicone rubber and urethane rubber. The material may be made from the elastic body which organic or inorganic material is added and dispersed in order to control the quantity of electrification of the toner.

Examples of the frame holding the binary component developer used as another frame holding the developer are a sleeve made of metal such as aluminum, SUS and brass; a sleeve of which the surface is treated by oxidizing, polishing or blasting in order to control the conveyance property and the electrification property of the toner. The developer is formed onto a development roller with separating between the layer-formed blade and the surface of the sleeve slightly.

In regard to the step for transferring, the toner image on the frame holding the latent image is transferred to the paper as the transcription sheet. Examples of the transferring procedure are a contact-type procedure of contacting the transferring roll device onto the frame holding the latent image with pressure; and a noncontact-type procedure using corotron. The contact-type procedure is preferable because of using the small-size device.

In regard to the step for cleaning, a cleaner removes the residual toner that is not transferred on the step for transfer ring. Example of the step for cleaning is a procedure using a cleaning blade or a cleaning roll. The cleaning blade made from the elastic rubber such as silicone rubber or urethane rubber is used.

In regard to the step for fixing, a fixing device fixes the transferred toner image on the transcription sheet. The step for fixing is preferably a thermal fixing procedure using a heat roll. It may be a pressure fixing procedure.

Next, embodiments of the present invention are explained in detail. The invention is not limited to these embodiments.

Hereunder, examples of the charge control agent and the toner for developing the electrostatic image comprising the charge control agent, of the present invention, are explained in detail.

The charge control agents A to F comprising the azo-type iron complex salt represented by the chemical formula (1) to which this invention was applied, and the charge control agents G to H to which this invention was not applied, were prepared. And a chemical analysis and a physical evaluation of the toners were carried out.

the dried monoazo compound was measured by atomic absorption spectrophotometry, the amount of sodium was 0.01% and the amount of potassium was 0.04%. 2000 g of the wet cake of the monoazo compound was dispersed in the mixed solvent of 370 g of normal butanol and 6740 g of water. 275.9 g of 48.5% potassium hydroxide aqueous solution, which the amount of residual potassium in the compound as colorant to converted solid weight of the wet cake was deducted, was added to the mixed solvent. It was heated at 90° C., and stirred to disperse for an hour. Then 402.0 g of 41% ferric sulfate aqueous solution with 1300 ppm of concentration of Mn was added dropwise. pH of the reaction mixture was 3.1 in this time. It was heated at 94° C., and refluxed for 5 hours, to prepare the azo-type iron complex salt. The precipitated azo-type iron complex salt was filtrated out and washed with 30 kg of 60° C. ion-exchanged water. The electric conductivity of the filtrate was 85 micro S. The filtrated cake was dried to obtain 752.9 g of the desired charge control agent A comprising the azo-type iron complex salt represented by the following chemical formula (3).

(3)

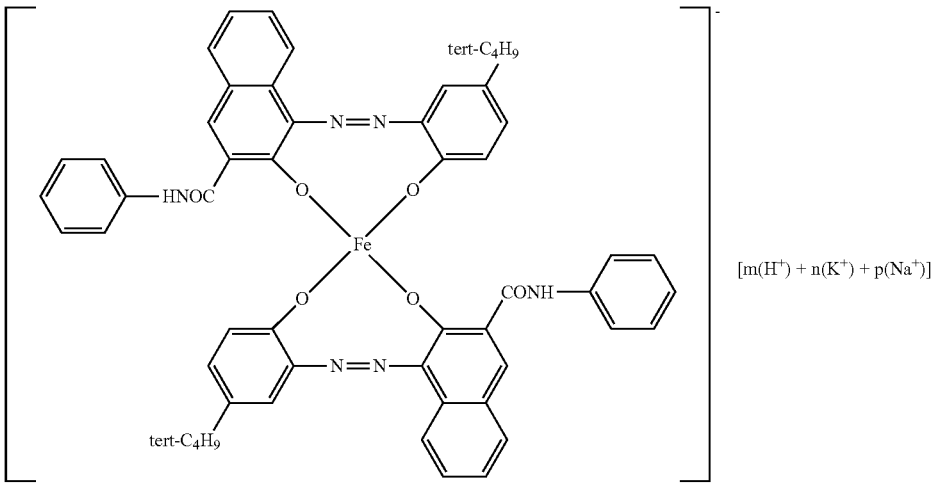

Preparing Example 1

Charge Control Agent A (1.1 Preparation of Charge Control Agent A)

The charge control agent A was prepared as follows.

(1) Synthesis of Monoazo Colorant 5821.0 g of 4-tert-butyl-2-aminophenol as a starting material and 1095.62 g of concentrated hydrochloric acid were added to 2525 L of water. For diazotization, 628.7 g of 36% sodium nitrite aqueous solution was added thereto gradually with cooling a reaction vessel by ice, to obtain the diazonium salt. A mixed solution of the obtained diazonium salt solution and 616.4 g of butanol was added dropwise to aqueous solution of 805.7 g of Naphthol AS, 964.9 g of 48.5% potassium hydroxide aqueous solution and 4 L of water, and then it was reacted for 2 hours. The precipitated monoazo compound was filtrated out and washed with water, to obtain 3511 g of the wet cake having 63.2% of water content.

(2) Synthesis of Azo-type Iron Complex Salt and Preparation of Charge Control Agent When 10 g of the wet cake of the obtained monoazo compound was dried and the amount of sodium and potassium in (1.2) Analysis and Evaluation of Charge Control Agent A)

The charge control agent A was analyzed chemically and evaluated physically as follows.

(Measurement 1) Measurement of Average Particle Size

Approximately 10 mg of the charge control agent of the aggregate particles was added to 10 v/v % solution of an activator: DRYWELL that is available from Fuji Photo Film Co., Ltd., to prepare a suspension. The suspension was irradiated with the ultrasonic wave for 10 minutes. 0.1 mL of the suspension was added into approximately 260 mL of water with a particle size distribution measurement equipment LA-910 that is available from Horiba, Ltd. to disperse. It was irradiated with the ultrasonic wave for 1 minute further in order to disperse the particles finely, and then the particle size distribution thereof was measured. The average particle size of the charge control agent A was 2.5 microns.

(Measurement 2) Measurement of Specific Volume Resistivity

The specific volume resistivity of the charge control agent A as a measurement sample was measured using the equipment shown in FIG. 1.

The measurement sample 6 was filled in a ring 3 made of polytetrafluoroethylene. The measurement sample 6 was located in contact with an electrode 1 of the under-side thereof and another electrode 2 of the upper-side thereof. The voltage was applied between both electrodes while the upper electrode 2 of the upper-side was weighted with load, and the flowed current thereof was measured using an ammeter 5, to determine the specific volume resistivity of the charge control agent A. A measurement condition was as follows; the temperature was 23±2° C., the humidity was 50±5% RH, the load to the electrode 2 of the upper-side was 2000 kg, the applied direct current voltage was 500V. The specific volume resistivity of the charge control agent A was $0.92\times10^{15}$ Ω·cm.

(Measurement 3) Differential Thermal-Thermogravimetric Analysis

The thermogravimetric analysis was performed using an equipment of TG/DTA6200 that is available from SII Nano-Technology Inc. The sample was heated to 550° C. for the analysis using the equipment. The weight-decrease of the charge control agent was 92.3%.

(Measurement 4)

(1) Analysis of Counter Ions

Measurement of Amount of Hydrogen Ion, Amount of Sodium Ion and Amount of Potassium Ion and (2) Metallic Analysis of Ferric Sulfate and Impurities (Metallic Salt or Metallic Oxide)

Measurement of Amount of Mn

An amount of sodium and an amount of potassium in the charge control agent were measured using atomic absorption spectrophotometer SpectrAA-220FS that is available from Varian Technologies Japan Ltd. An existence mole % ratio as the counter ion was as follows: hydrogen ion was 99.7%, sodium ion was 0% and potassium ion was 0.3%. The amount of Mn of impurity was 50 ppm or less.

(Measurement 5) Measurement of Specific Surface Area

A pretreatment of vacuum deairing was performed to the sample at room temperature. Then the specific surface area of the charge control agent, that is B.E.T., was measured using specific surface area measurement equipment AUTOSORB 3 that is available from QUANTACHROME Corporation. The specific surface area of the charge control agent was 9.3 $m^2/g$.

Preparing Example 2

Charge Control Agent B

The charge control agent B was prepared as same as Preparing Example 1 except for using 296 g of normal butanol and 5329 g of water instead of using the mixed solvent of normal butanol and water in Preparing Example 1. The charge control agent B comprises the azo-type iron complex salt represented by the chemical formula (3), and the ratio of m, n and p of the counter ion of the charge control agent B is different from that of the charge control agent A. The charge control agent B was analyzed chemically and evaluated physically as same as Preparing Example 1. The results are shown in Table 1. The result of the metallic analysis of impurities in the charge control agent B was same as the result of Example 1.

TABLE 1

| | | Charge Control Agent No. | |
|---|---|---|---|
| | | Charge Control Agent A | Charge Control Agent B |
| Ratio of m, n, p in $m(H^+) + n(K^+) + p(Na^+)$ of Counter Ion in Azo-type Iron Complex Salt | m | 0.997 | 0.993 |
| | n | 0.003 | 0.007 |
| | p | 0 | 0 |
| Average Particle Size (microns) | | 2.5 | 3.8 |
| Specific Volume Resistivity ($\times10^{15}\Omega\cdot cm$) | | 0.9 | 2.3 |
| Ratio of Weight-Decrease (%) | | 92.3 | 92.5 |
| Specific Surface Area ($m^2/g$) | | 9.3 | 6.1 |

Preparing Example 3

Charge Control Agent C

The charge control agent C was prepared as same as Preparing Example 1 except for using 333 g of normal butanol and 6066 g of water instead of using the mixed solvent of normal butanol and water in Preparing Example 1. The charge control agent C comprises the azo-type iron complex salt represented by the chemical formula (3), and the ratio of m, n and p of the counter ion of the charge control agent C is different from that of the charge control agent A. The charge control agent C was analyzed chemically and evaluated physically as same as Preparing Example 1. The results are shown in Table 2. The result of the metallic analysis of impurities in the charge control agent C was same as the result of Example 1.

Preparing Example 4

Charge Control Agent D

The charge control agent D was prepared as same as Preparing Example 1 except for using 260 g of 20% sodium hydroxide aqueous solution instead of using 48.5% potassium hydroxide aqueous solution in Preparing Example 1. The charge control agent D comprises the azo-type iron complex salt represented by the chemical formula (3), and the ratio of m, n and p of the counter ion of the charge control agent D is different from that of the charge control agent A. The charge control agent D was analyzed chemically and evaluated physically as same as Preparing Example 1. The results are shown in Table 2. The result of the metallic analysis of impurities in the charge control agent D was same as the result of Example 1.

TABLE 2

| | | Charge Control Agent No. | |
|---|---|---|---|
| | | Charge Control Agent C | Charge Control Agent D |
| Ratio of m, n, p in $m(H^+) + n(K^+) + p(Na^+)$ of Counter Ion in Azo-type Iron Complex Salt | m | 0.995 | 1.0 |
| | n | 0.005 | 0 |
| | p | 0 | 0 |
| Average Particle Size (microns) | | 2.4 | 3.9 |
| Specific Volume Resistivity ($\times10^{15}\Omega\cdot cm$) | | 0.7 | 3.6 |
| Ratio of Weight-Decrease (%) | | 92.2 | 91.3 |

Preparing Example 5

Charge Control Agent E

The charge control agent E was prepared as same as Preparing Example 1 except for using 4-n-pentyl-2-aminophenol instead of using 4-tert-butyl-2-aminophenol in 1.1 (1) of Preparing Example 1, and except for using 353 g of 48.5% potassium hydroxide aqueous solution instead of using 275.9 g of 48.5% potassium hydroxide aqueous solution in Preparing Example 1. The charge control agent E comprises the azo-type iron complex salt represented by the following chemical formula (4), and the ratio of m, n and p of the counter ion of the charge control agent E is different from that of the charge control agent A. The charge control agent E was analyzed chemically and evaluated physically as same as Preparing Example 1. The results are shown in Table 3.

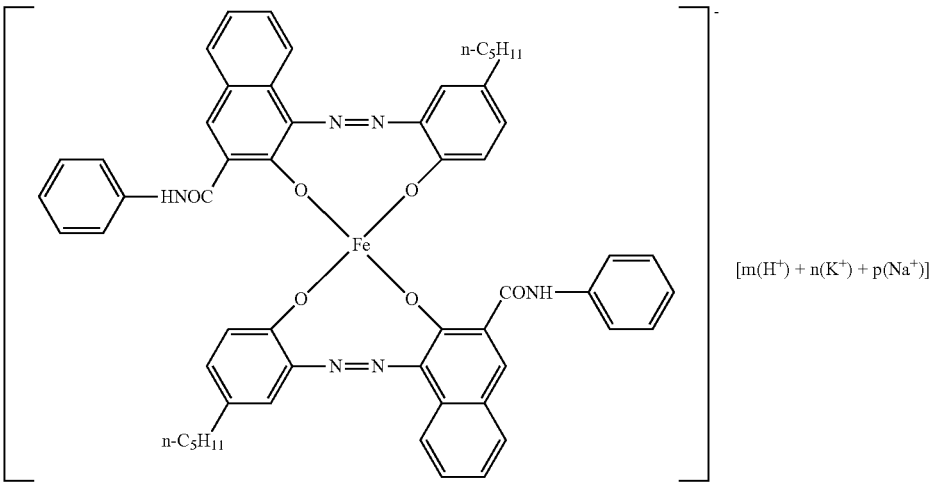

(4)

Preparing Example 6

Charge Control Agent F

The charge control agent F was prepared as same as Preparing Example 1 except for using 303.5 g of 48.5% potassium hydroxide aqueous solution instead of using 48.5% potassium hydroxide aqueous solution in Preparing Example 1. The charge control agent F comprises the azo-type iron complex salt represented by the chemical formula (3), and the ratio of m, n and p of the counter ion of the charge control agent F is different from that of the charge control agent A. The charge control agent F was analyzed chemically and evaluated physically as same as Preparing Example 1. The results are shown in Table 3.

TABLE 3

| | | Charge Control Agent No. | |
|---|---|---|---|
| | | Charge Control Agent E | Charge Control Agent F |
| Ratio of m, n, p in $m(H^+) + n(K^+) + p(Na^+)$ of Counter Ion in Azo-type Iron Complex Salt | m | 0.85 | 0.79 |
| | n | 0.13 | 0.15 |
| | p | 0.02 | 0.06 |
| Average Particle Size (microns) | | 3.9 | 3.4 |

TABLE 3-continued

| | Charge Control Agent No. | |
|---|---|---|
| | Charge Control Agent E | Charge Control Agent F |
| Specific Volume Resistivity ($\times 10^{15}\Omega \cdot cm$) | 1.4 | 0.8 |

Comparative Preparing Example 1

Charge Control Agent G

The charge control agent G to which this invention was not applied was prepared as same as Preparing Example 1 except for using 5000 g of only butanol instead of using the mixed solvent of normal butanol and water in Preparing Example 1. The charge control agent G comprises the azo-type iron complex salt represented by the chemical formula (3), and the ratio of m, n and p of the counter ion of the charge control agent G is different from that of the charge control agent A. The charge control agent G was analyzed chemically and evaluated physically as same as Preparing Example 1. The results are shown in Table 4.

Comparative Preparing Example 2

Charge Control Agent H

The charge control agent H to which this invention was not applied was prepared as same as Preparing Example 1 except for using 4-methyl-2-aminophenol instead of using 4-tert-butyl-2-aminophenol in 1.1 (1) of Preparing Example 1, and except for using 250 g of 48.5% potassium hydroxide aqueous solution instead of using potassium hydroxide aqueous solution in Preparing Example 1. The charge control agent H comprises the azo-type iron complex salt represented by the following chemical formula (5), and the ratio of m, n and p of the counter ion of the charge control agent H is different from that of the charge control agent A. The charge control agent H was analyzed chemically and evaluated physically as same as Preparing Example 1. The results are shown in Table 4.

(5)

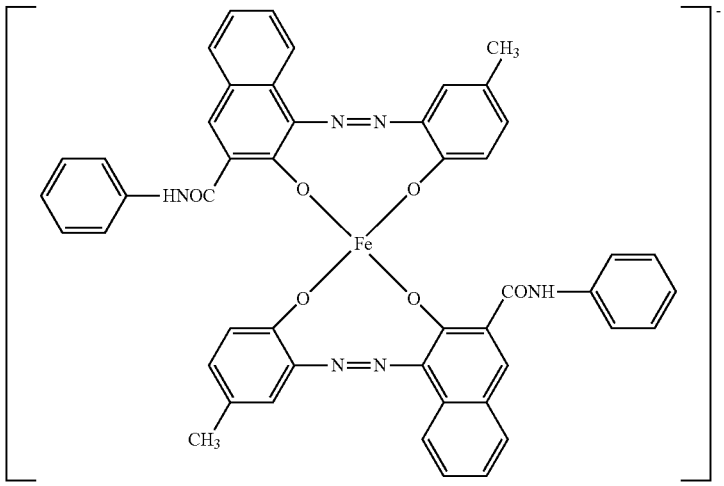

$[m(H^+) + n(K^+) + p(Na^+)]$

TABLE 4

| | | Charge Control Agent No. | |
|---|---|---|---|
| | | Charge Control Agent G | Charge Control Agent H |
| Ratio of m, n, p in $m(H^+) + n(K^+) + p(Na^+)$ of Counter Ion in Azo-type Iron Complex Salt | m | 1.0 | 0.998 |
| | n | 0 | 0.002 |
| | p | 0 | 0 |
| Average Particle Size (microns) | | 4.9 | 3.0 |
| Specific Volume Resistivity ($\times 10^{15}\Omega \cdot cm$) | | 5.1 | 0.8 |
| Ratio of Weight-Decrease (%) | | 91.6 | 84.2 |

For comparison, the charge control agent T-77 represented by the following chemical formula (6), which is available from Hodogaya Chemical Co., Ltd., was analyzed chemically and evaluated physically as same as Preparing Example 1. The results are shown in Table 5.

(6)

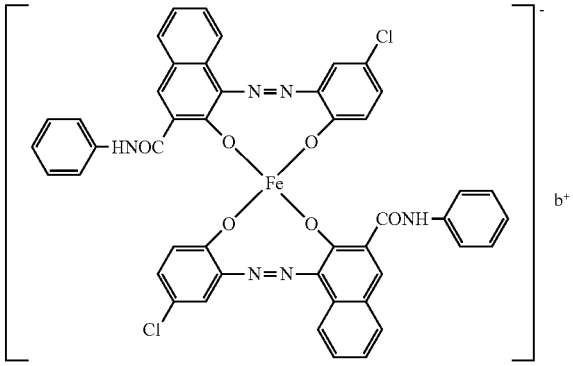

[in the chemical formula, the counter ion $b^+$ is mixed cations of ammonium ion ($NH_4^+$), sodium ion and hydrogen ion, and it is presumed that the amount of $NH_4^+$ is 95% or more.]

TABLE 5

| | |
|---|---|
| Charge Control Agent No. | T-77 |
| Counter Ion in Azo-type Iron Complex Salt | $NH_4^+$ is 95% or more |
| Average Particle Size (microns) | 3.0 |
| Specific Volume Resistivity ($\times 10^{15}\Omega \cdot cm$) | 0.1 |
| Ratio of Weight-Decrease (%) | 91.7 |

Next, the toners for developing the electrostatic image to which this invention was applied were prepared using the charge control agents A to F respectively. And the toners for developing the electrostatic image to which this invention was not applied were also prepared using the charge control agents G to H and the charge control agent T-77 respectively. Measurement of quantity of the frictional electrification and evaluation of the environmental stability of electrification quantity were performed to these toners.

Example 1

100 parts by weight of styrene-acrylate copolymer resin: CPR-600B which is available from Mitsui Chemicals, Inc., 2 parts by weight of low grade polypropylene: VISCOL 550-P which is available from Sanyo Chemical Industries, Ltd., 6 parts by weight of carbon black: MA100 which is available from Mitsubishi Chemical Corporation, and 1 part by weight of the charge control agent A, were pre-mixed homogeneously using a high speed mixer. The mixture was kneaded with melting using a biaxial mixing extruder: S1KRC kneader which is available from Kurimoto, Ltd. at 130° C. It was cooled and crushed roughly using a rotor mill: ZM1 which is available from Retsch Co., Ltd. The prepared rough granules were finely granulated using an air jet mill equipping with a classifier: CO-JET System alpha which is available from SEISHIN ENTERPRISE CO., LTD., to obtain the toner having 10 microns of the particle size thereof.

2.5 parts by weight of the obtained toner and 50 parts by weight of the carrier of iron powder: F-150 which is available from Powder Tech Corporation were mixed to prepare the developer.

(Measurement 6) Measurement of Quantity of Frictional Electrification 2.5 parts by weight of the obtained toner and 50 parts by weight of the carrier of iron powder: F-150 which is available from Powder Tech Corporation were weighed in a plastic bottle, and then they were agitated at 100 rpm of rotating speed by a ball mill to be electrified. The quantity of electrification with the passage of time was measured under standard condition of 20° C. and 60% Relative Humidity. Measurement results of the quantity of the frictional electrification at every agitation time (minute) are shown in Table 6.

(Measurement 7) Environmental Stability of Quantity of Electrification

The initial blow-off quantity of the electrification was measured similarly under each conditions: a low temperature and low humidity condition of 5° C. and 30% relative humidity, a normal temperature and normal humidity condition of 25° C. and 50% relative humidity, and a high temperature and high humidity condition of 35° C. and 90% relative humidity. Measurement results of the initial blow-off quantity of the electrification, namely the environmental stability of the quantity of electrification, are shown in Table 7. The rate of decrease of the quantity of electrification shows the rate of decrease of the initial blow-off quantity of the electrification under high temperature and high humidity condition to the initial blow-off quantity of the electrification under normal temperature and normal humidity condition.

Examples 2 to 6

The toners of Examples 2 to 6 were prepared as same as Example 1 except for using charge control agents B to F respectively instead of using charge control agent A in Example 1. The quantity of frictional electrification and the environmental stability of quantity of electrification of obtained toners were measured as same as Example 1. Measurement results are shown in Tables 6 and 7.

Comparative Examples 1 to 2

The toners of Comparative Examples 1 to 2 were prepared as same as Example 1 except for using charge control agents G to H respectively instead of using charge control agent A in Example 1. The quantity of frictional electrification and the environmental stability of quantity of electrification of obtained toners were measured as same as Example 1. Measurement results are shown in Tables 6 and 7.

Comparative Example 3

The toner of Comparative Example 3 was prepared as same as Example 1 except for using charge control agent T-77 instead of using charge control agent A in Example 1. The quantity of frictional electrification and the environmental stability of quantity of electrification of obtained toner were measured as same as Example 1. Measurement results are shown in Tables 6 and 7.

TABLE 6

| | Charge | Quantity of Frictional Electrification at every agitation time (−μC/g) | | | | |
|---|---|---|---|---|---|---|
| Examples | Control Agent | 3 Minutes | 5 Minutes | 10 Minutes | 20 Minutes | 30 Minutes |
| Example 1 | A | 21.50 | 24.84 | 29.31 | 33.21 | 35.14 |
| Example 2 | B | 23.50 | 26.55 | 30.53 | 35.93 | 36.54 |
| Example 3 | C | 22.50 | 25.70 | 29.92 | 34.57 | 36.34 |
| Example 4 | D | 21.99 | 25.82 | 30.52 | 35.02 | 37.25 |
| Example 5 | E | 23.25 | 25.25 | 28.26 | 32.93 | 33.51 |
| Example 6 | F | 21.48 | 26.53 | 29.49 | 33.32 | 35.49 |
| Comp. Example 1 | G | 16.50 | 23.55 | 31.53 | 37.93 | 40.54 |
| Comp. Example 2 | H | 9.45 | 12.03 | 14.99 | 18.25 | 19.24 |
| Comp. Example 3 | T-77 | 13.50 | 17.09 | 21.84 | 26.36 | 28.01 |

TABLE 7

| | Charge | Quantity of Electrification under Different Temperature and Humidity (−μC/g) | | | Rate of Decrease of Quantity of |
|---|---|---|---|---|---|
| Examples | Control Agent | 5° C.-30% RH | 25° C.-50% RH | 35° C.-90% RH | Electrification (%) |
| Example 1 | A | 32.6 | 32.5 | 31.7 | 2.5 |
| Example 2 | B | 37.5 | 37.9 | 36.6 | 3.4 |
| Example 3 | C | 37.0 | 36.5 | 35.4 | 3.0 |
| Example 4 | D | 34.5 | 34.7 | 34.3 | 1.2 |
| Example 5 | E | 34.7 | 33.6 | 32.9 | 4.5 |
| Example 6 | F | 35.0 | 34.2 | 32.4 | 5.3 |
| Comp. Example 1 | G | 39.1 | 38.2 | 36.5 | 4.5 |
| Comp. Example 2 | H | 26.1 | 25.7 | 22.5 | 12.5 |
| Comp. Example 3 | T-77 | 25.0 | 24.7 | 22.1 | 10.5 |

According to Table 6, it is obvious that the toner of Comparative Example 1 has slow rise speed of the electrification because the average particle size of the charge control agent comprising the azo-type iron complex salt in the toner is too large and consequently the charge control agent is dispersed into the toner insufficiently. As compared with it, the toners of Examples cause the excellent rise speed of electrification and the sufficient saturated quantity of electrification because the charge control agent comprising the azo-type iron complex salt in the toner has the appropriate specific volume resistivity and the appropriate average particle size.

According to Tables 6 and 7, it is obvious that the toner of Comparative Example 2 causes the insufficient saturated quantity of electrification and lacks the environmental stability because the length of alkyl group in the azo-type iron complex salt of the charge control agent in the toner is short and consequently the hydrophobic property of the toner is not improved. As compared with it, the toners of Examples have the excellent electrification stability and little change of quantity of electrification under various conditions.

When the specific volume resistivity of the charge control agent comprising the azo-type iron complex salt in the toner is low, the toner has the insufficient saturated quantity of electrification. And when the specific volume resistivity thereof is high, the toner lacks an stability.

Next, the liberation rate that the iron of the central metal in the azo-type iron complex salt represented by the chemical formula (1) is liberated from the toner, was measured.

(Measurement 8) Measurement of Liberation Rate of Azo-type Iron Complex Salt from Toner Particle The liberation of the azo-type iron complex salt from the toner was estimated by measurement of the liberation of the iron of the central metal.

The liberation rates of the iron from toners prepared in Example 1, Example 4 and Comparative Example 3 were measured using Particle Analyzer DP-1000 that is available from HORIBA, Ltd., and then the synchronous distribution diagrams of the toners were drawn up. The results thereof are shown in Table 8 and FIG. 2 to FIG. 4.

C—Fe distribution width in the following Table 8 is a distribution width of a plot of a gradient of a cube-root voltage corresponding to the particle size of the iron against a cube-root voltage corresponding to the particle size of the toner that is shown as the mother material C in FIG. 2 to FIG. 4. When the distribution width thereof is narrow, it is shown that the iron is attached homogeneously to the toner and there is no variation in the concentration of the iron. In Table 8, the distribution width measured from the toner prepared in Comparative Example 3 is determined as a standard, and is compared with the distribution width measured from the toner prepared in Examples.

When powder comprising mixture of plural sorts of pure substance is in plasma, luminous signals corresponding to each pure substance are observed with a time lag. But when deposited powder comprising plural sorts of pure substance is in plasma, a simple luminous signal is observed synchronously. Using these properties, the synchronous distribution diagram is drawn out by measuring the luminous signals of the toner. The liberation rate of the iron is determined as a rate of luminescence of the simple substances of iron. Therefore, the liberation rate of the iron is a rate of the iron which does not emit the light simultaneously with the mother material C, namely the toner, and indicates a rate of Fe particle that does not adherent to the toner.

TABLE 8

| Toner | C—Fe Distribution | Width | Liberation Rate of Iron |
|---|---|---|---|
| Example 1 | 0.172 | Narrow | 1.88 |
| Example 4 | 0.227 | Narrow | 1.85 |
| Comparative Example 3 | 0.252 | Standard | 3.43 |

Figure 2:
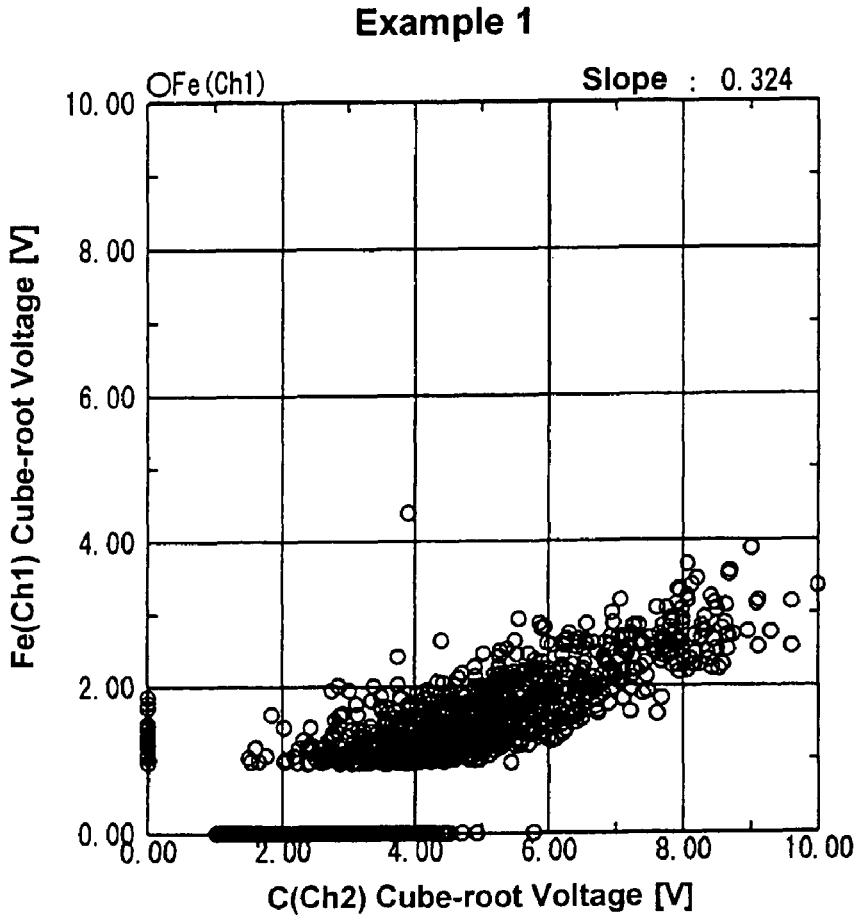
FIG. 2 is a synchronous distribution diagram of the toner for developing the electrostatic image in Example 1 to which the present invention is applied, measured by a particle analyzer.
Figure 3:
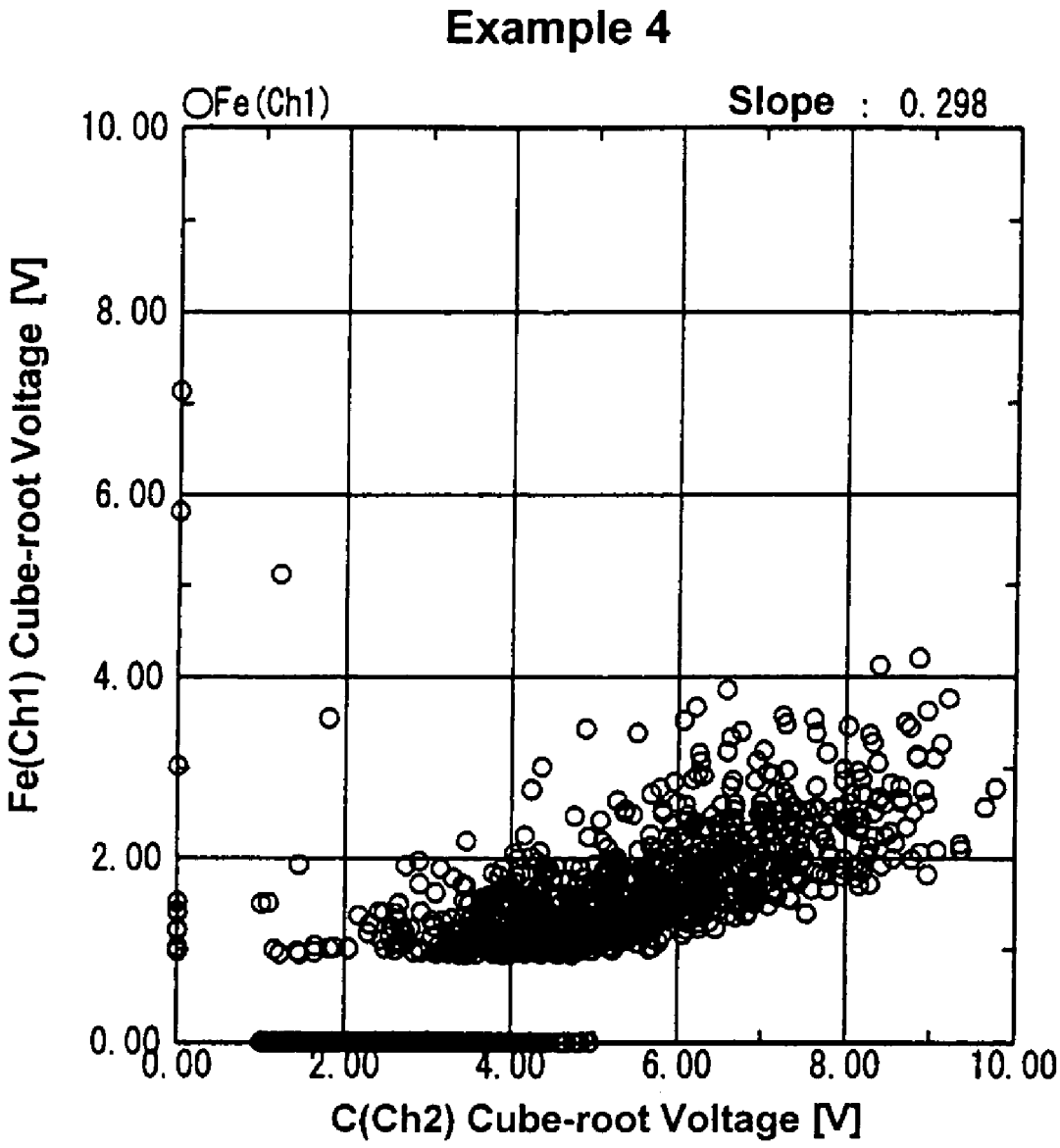
FIG. 3 is a synchronous distribution diagram of the toner for developing the electrostatic image in Example 4 to which the present invention is applied, measured by a particle analyzer.
Figure 4:
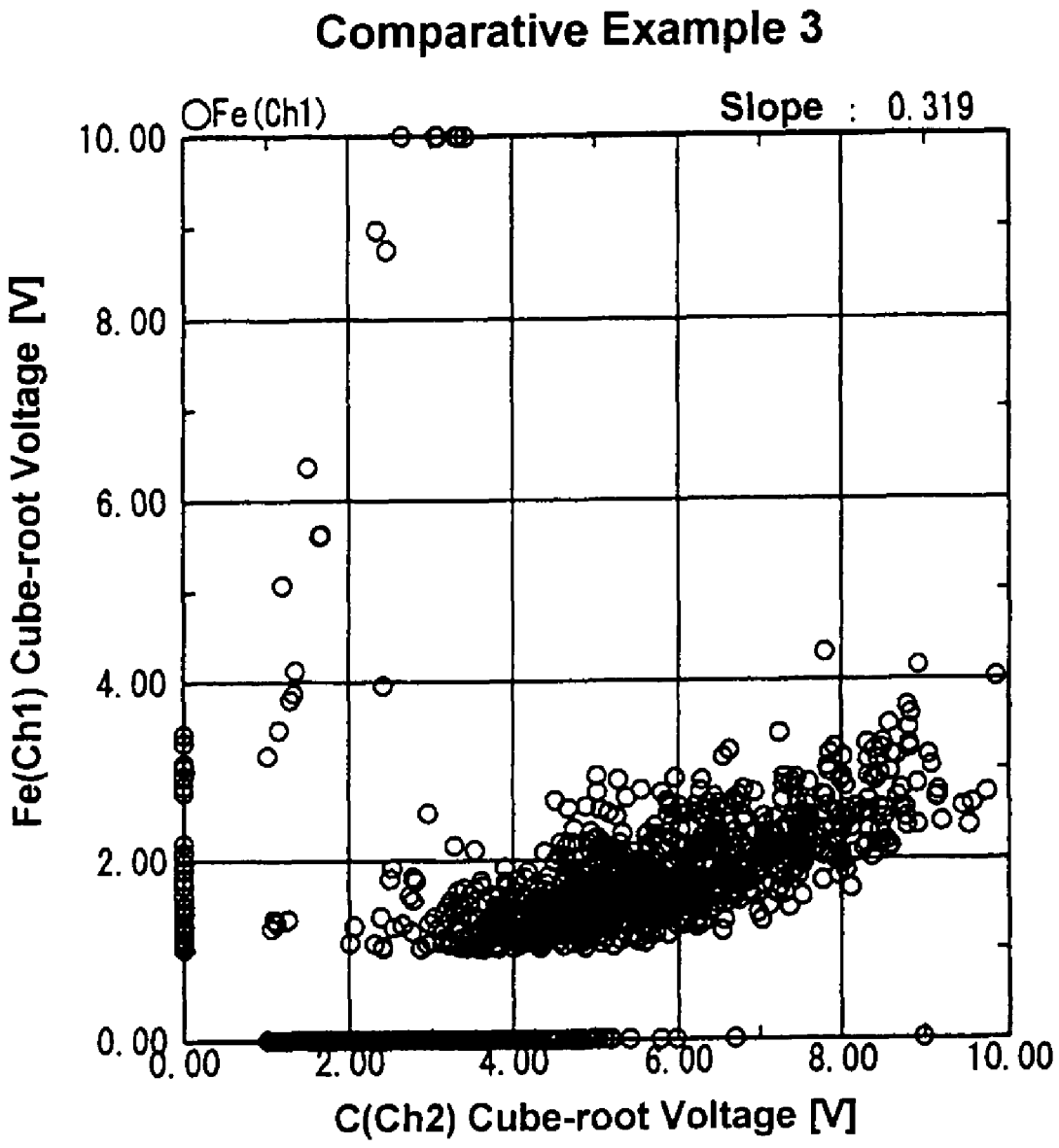
FIG. 4 is a synchronous distribution diagram of the toner for developing the electrostatic image in Comparative Example 3 to which the present invention is not applied, measured by a particle analyzer.

According to Table 8 and FIG. 2 to FIG. 4, it is obvious that the liberation rate of the iron of the toner prepared in Examples is 3% or less. When the liberation rate of the iron of the charge control agent is ranging from 0.01 to 3.00%, the charge control agent certainly exists onto the surface of the toner particles. Consequently, the toner is electrified homogeneously and has the excellent rise speed of the frictional electrification. If the liberation rate of the iron of the charge control agent is high, the amount of the charge control agent liberated or eliminated from the surface layer of the toner particle increases remarkably. So liberated or eliminated charge control agent adheres and is fixed onto the surface of the carrier, and consequently the electrification-investing property of the carrier is declined remarkably.

INDUSTRIAL APPLICABILITY

The charge control agent of the present invention is used for electrifying the toner or the powder paint. The toner comprising the charge control agent is used for printing or for copying by the image formation process such as the electrophotography system.

What is claimed is:

1. A toner for developing an electrostatic image comprising a binding resin and a charge control agent including an azo-type iron complex salt represented by the following chemical formula (1)

(1)

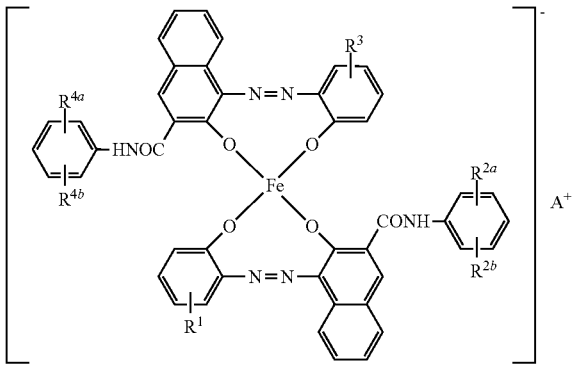

wherein $R^1$ and $R^3$ are the same or different from each other and are an alkyl group having a straight chain or a branch chain of 3 to 8 carbons; $R^{2a}$, $R^{2b}$, $R^{4a}$ and $R^{4b}$ are the same or different from each other and are selected from the group consisting of a hydrogen atom, an alkyl group, an alkoxyl group, a halogen atom, a nitro group and a carboxyl group; $A^+$ indicates $m(H^+)+n(K^+)$, wherein m and n satisfy numerical equations of $m+n=1$, $0.7 \leqq m<1$, and $0<n \leqq 0.3$, wherein an average particle size of the charge control agent is 1 to 4 microns, and a specific volume resistivity thereof is ranging from $0.2\times10^{15}$ to $7\times10^{15}\Omega\cdot$cm.

2. The toner for developing the electrostatic image according to claim 1, wherein a rate of weight-decrease of the azo-type iron complex salt by a differential thermal-thermogravimetric analysis is 90% or more.

3. The toner for developing the electrostatic image according to claim 1, further comprising a wax.

4. The toner for developing the electrostatic image according to claim 1, wherein a liberation rate of free azo-type iron complex salt represented by chemical formula (1) which is liberated from the toner particles, compared to azo-type iron complex salt represented by chemical formula (1) which is attached to the toner particles, ranges from 0.01 to 3%.

5. The toner for developing the electrostatic image according to claim 1, wherein a rate of decrease of a quantity of electrification under high temperature of 35° C. and high humidity of 90% relative humidity to a quantity of electrification under 25° C. and 50% relative humidity is ranging from 0.1 to 10%.

6. The toner for developing the electrostatic image according to claim 1, comprising 0.1 to 10 parts by weight of the charge control agent and 100 parts by weight of the binding resin for the toner.

7. The toner for developing the electrostatic image according to claim 1, wherein the charge control agent has a specific surface area x which satisfies a formula of $5 \leqq x \leqq 15$ ($m^2/g$).

8. An image formation process comprising:

forming a toner layer on a frame, wherein said toner comprises a binding resin and a charge control agent including an azo-type iron complex salt represented by the following chemical formula (1)

(1)

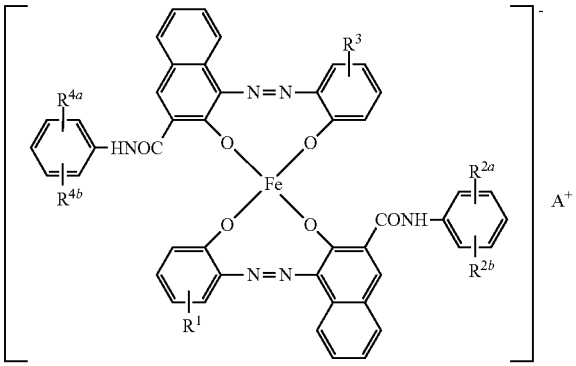

wherein $R^1$ and $R^3$ are the same or different from each other and are an alkyl group having a straight chain or a branch chain of 3 to 8 carbons; $R^{2a}$, $R^{2b}$, $R^{4a}$ and $R^{4b}$ are the same or different from each other and are selected from the group consisting of a hydrogen atom, an alkyl group, an alkoxyl group, a halogen atom, a nitro group and a carboxyl group; $A^+$ indicates $m(H^+)+n(K^+)$, wherein m and n satisfy numerical equations of $m+n=1$, $0.7 \leqq m<1$, and $0<n \leqq 0.3$, wherein an average particle size of the charge control agent is 1 to 4 microns, and a specific volume resistivity thereof is $0.2\times10^{15}$ to $7\times10^{15}$ Ω·cm; and developing an electrostatic latent image by transferring toner from the toner layer on said frame onto frame having an electrostatic latent image.

9. The image formation process according to claim 8, wherein a rate of weight-decrease of the azo-type iron complex salt by a differential thermal-thermogravimetric analysis is 90% or more.

10. The image formation process according to claim 8, wherein the toner further comprises a wax.

11. The image formation process according to claim 8, wherein a liberation rate of free azo-type iron complex salt represented by chemical formula (1) which is liberated from the toner particles, compared to azo-type iron complex salt represented by chemical formula (1) which is attached to the toner particles, ranges from 0.01 to 3%.

12. The image formation process according to claim 8, wherein a rate of decrease of a quantity of electrification of the toner under high temperature of 35° C. and high humidity of 90% relative humidity to a quantity of electrification of the toner under 25° C. and 50% relative humidity is ranging from 0.1 to 10%.

13. The image formation process according to claim 8, wherein the toner comprises 0.1 to 10 parts by weight of the charge control agent and 100 parts by weight of the binding resin for the toner.

14. The image formation process according to claim 8, wherein the charge control agent has a specific surface area x which satisfies a formula of $5 \leqq x \leqq 15$ ($m^2/g$).

* * * * *